US009523952B2

(12) United States Patent
Yasuda et al.

(10) Patent No.: US 9,523,952 B2
(45) Date of Patent: Dec. 20, 2016

(54) IMAGE FORMING APPARATUS, SWITCHABLE TO A QUIET MODE

(71) Applicants: Jun Yasuda, Chiba (JP); Naoyuki Okamoto, Tokyo (JP)

(72) Inventors: Jun Yasuda, Chiba (JP); Naoyuki Okamoto, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/612,430

(22) Filed: Feb. 3, 2015

(65) Prior Publication Data

US 2015/0234333 A1 Aug. 20, 2015

(30) Foreign Application Priority Data

Feb. 14, 2014 (JP) ..... 2014-026428

(51) Int. Cl.
*G03G 15/00* (2006.01)

(52) U.S. Cl.
CPC ..... *G03G 15/5016* (2013.01)

(58) Field of Classification Search
CPC ..... G03G 15/50
USPC ..... 399/82
See application file for complete search history.

(56) References Cited

U.S. PATENT DOCUMENTS

| | | | |
|---|---|---|---|
| 7,574,153 | B2 * | 8/2009 | Nakayama |
| 8,165,489 | B2 * | 4/2012 | Mikuni |
| 2007/0058219 | A1 * | 3/2007 | Yamaguchi |
| 2007/0144367 | A1 | 6/2007 | Mori |
| 2009/0317109 | A1 | 12/2009 | Ehara et al. |
| 2010/0183322 | A1 | 7/2010 | Funamoto et al. |
| 2010/0239318 | A1 | 9/2010 | Maehata et al. |
| 2010/0303504 | A1 | 12/2010 | Funamoto et al. |
| 2011/0044724 | A1 | 2/2011 | Funamoto et al. |
| 2011/0058827 | A1 | 3/2011 | Maehata et al. |
| 2011/0211849 | A1 | 9/2011 | Okamoto |
| 2013/0101314 | A1 | 4/2013 | Yasuda et al. |
| 2013/0237366 | A1 | 9/2013 | Yasuda et al. |

FOREIGN PATENT DOCUMENTS

| | | | |
|---|---|---|---|
| JP | 2004-198889 | | 7/2004 |
| JP | 2007057606 A | * | 3/2007 |
| JP | 2007-168395 | | 7/2007 |
| JP | 2010-013203 | | 1/2010 |
| JP | 2012068293 A | * | 4/2012 |
| JP | 2012-108365 | | 6/2012 |

* cited by examiner

*Primary Examiner* — Walter L Lindsay, Jr.
*Assistant Examiner* — Milton Gonzalez
(74) *Attorney, Agent, or Firm* — Harness, Dickey & Pierce, P.L.C.

(57) ABSTRACT

An image forming apparatus includes an operator, a receiver, and a controller. The operator accepts print instruction is input. The receiver receives a print instruction from an external terminal. The controller switches one of a standard mode and a quiet mode in which operating noise is lower than that in the standard mode. The controller also executes a print operation based on the print instruction from the operator in the standard mode.

20 Claims, 18 Drawing Sheets

FIG. 27

| LOCATION | STANDARD MODE -FAN- | QUIET MODE -FAN- |
|---|---|---|
| FIXING DEVICE | HIGH SPEED/ LOW SPEED | HIGH SPEED/ LOW SPEED |
| WRITING DEVICE | HIGH SPEED/ LOW SPEED | LOW SPEED |
| DEVELOPING DEVICE | HIGH SPEED/ LOW SPEED | LOW SPEED |
| TONER SUPPLY DEVICE | HIGH SPEED/ LOW SPEED | LOW SPEED |
| PSU | HIGH SPEED/ LOW SPEED | HIGH SPEED/ LOW SPEED |
| CONTROLLER | HIGH SPEED/ LOW SPEED | HIGH SPEED/ LOW SPEED |
| SHEET FEED UNIT | HIGH SPEED/ LOW SPEED | LOW SPEED |

FIG. 28

| PAPER THICKNESS $g/m^2$ | STANDARD MODE -MOTOR- | QUIET MODE -MOTOR- |
|---|---|---|
| PLAIN PAPER (-81) | HIGH SPEED | MEDIUM SPEED/ LOW SPEED |
| MEDIUM THICK PAPER (82-105) | MEDIUM SPEED | MEDIUM SPEED/ LOW SPEED |
| THICK PAPER (106-) | LOW SPEED | MEDIUM SPEED/ LOW SPEED |

IMAGE FORMING APPARATUS, SWITCHABLE TO A QUIET MODE

CROSS-REFERENCE TO RELATED APPLICATION

This patent application is based on and claims priority pursuant to 35 U.S.C. §119 to Japanese Patent Application No. 2014-026428, filed on Feb. 14, 2014, in the Japan Patent Office, the entire disclosure of which is hereby incorporated by reference herein.

BACKGROUND

Technical Field

Exemplary aspects of the present invention relate to an image forming apparatus such as a copier, a printer, a facsimile machine, and a multifunctional peripheral.

Related Art

When a user uses a copy function of an image forming apparatus, the user generally stands in front of the image forming apparatus to make a copy of a document. Such a copy operation generates noise. However, the operating noise may not annoy people near the image forming apparatus.

On the other hand, when the user uses a print function of the image forming apparatus, the user instructs a print operation from a terminal. Although the user is not standing in front of the image forming apparatus, noise of the copy operation is generated nonetheless. Consequently, such operating noise may annoy people near the image forming apparatus.

Thus, an image forming apparatus switchable between a standard mode and a quiet mode is known. Such an image forming apparatus can switch an operating mode to the standard mode and the quiet mode according to the copy function and the print function to deal with the above problem.

SUMMARY

In at least one embodiment of this disclosure, there is provided an improved image forming apparatus that includes an operator, a receiver, and a controller. The operator accepts print instruction input. The receiver receives a print instruction from an external terminal. The controller switches one of a standard mode and a quiet mode in which operating noise is lower than that in the standard mode. The controller also executes a print operation based on the print instruction from the operator in the standard mode.

BRIEF DESCRIPTION OF THE DRAWINGS

The aforementioned and other aspects, features, and advantages of the present disclosure would be better understood by reference to the following detailed description when considered in connection with the accompanying drawings, wherein:

FIG. 27 is a table of control of fans that rotate when the image forming apparatus illustrated in FIG. 1 is in a standard mode and a quiet mode; and FIG. 28 is a table of control of motors that rotate when the image forming apparatus illustrated in FIG. 1 is in a standard mode and a quiet mode.

Figure 1:
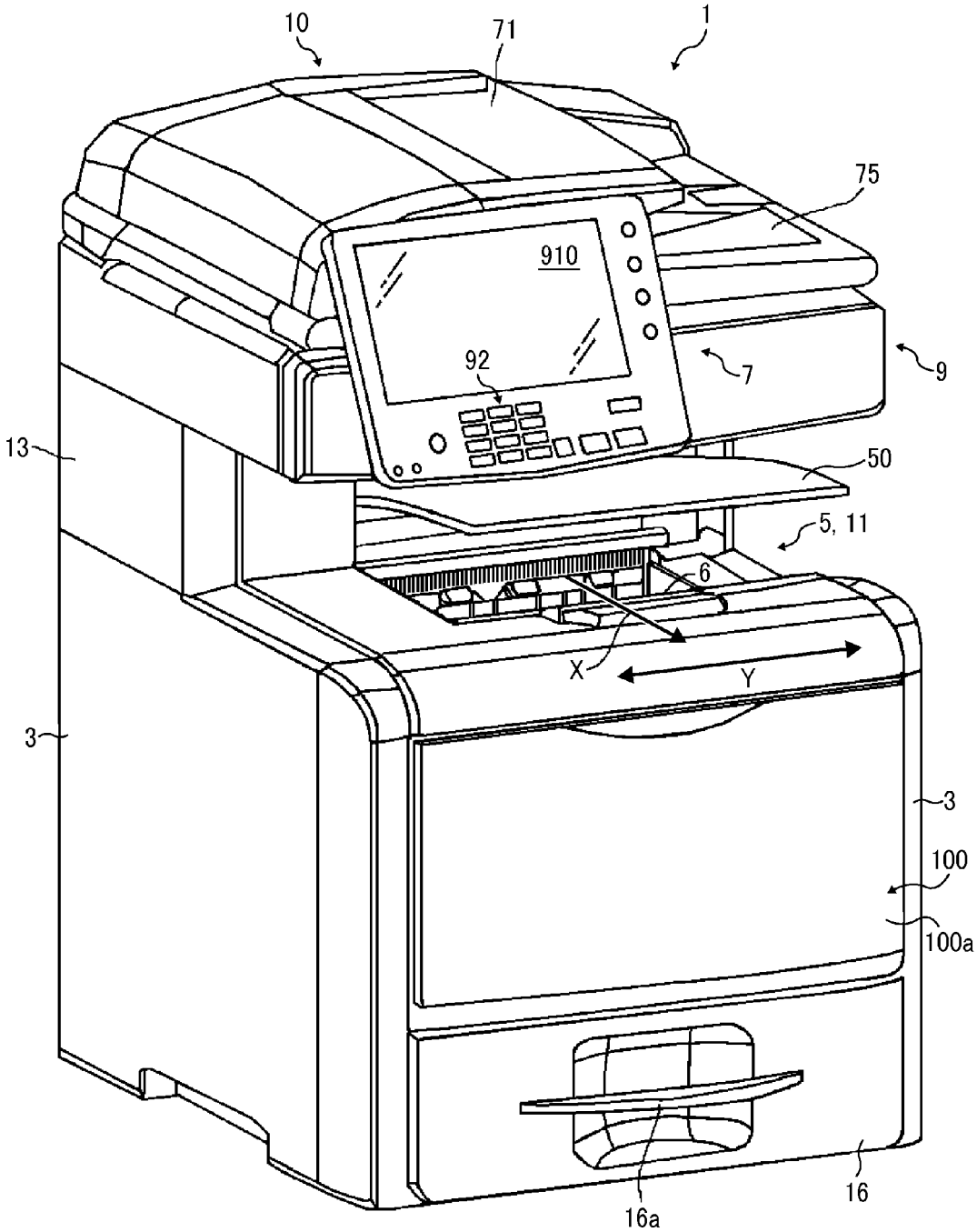
FIG. 1 is a schematic diagram of a configuration of an image forming apparatus according to an exemplary embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have a similar function, operate in a similar manner, and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

An image forming apparatus 1 according to an exemplary embodiment of the present invention is described with reference to the drawings.

Figure 2:
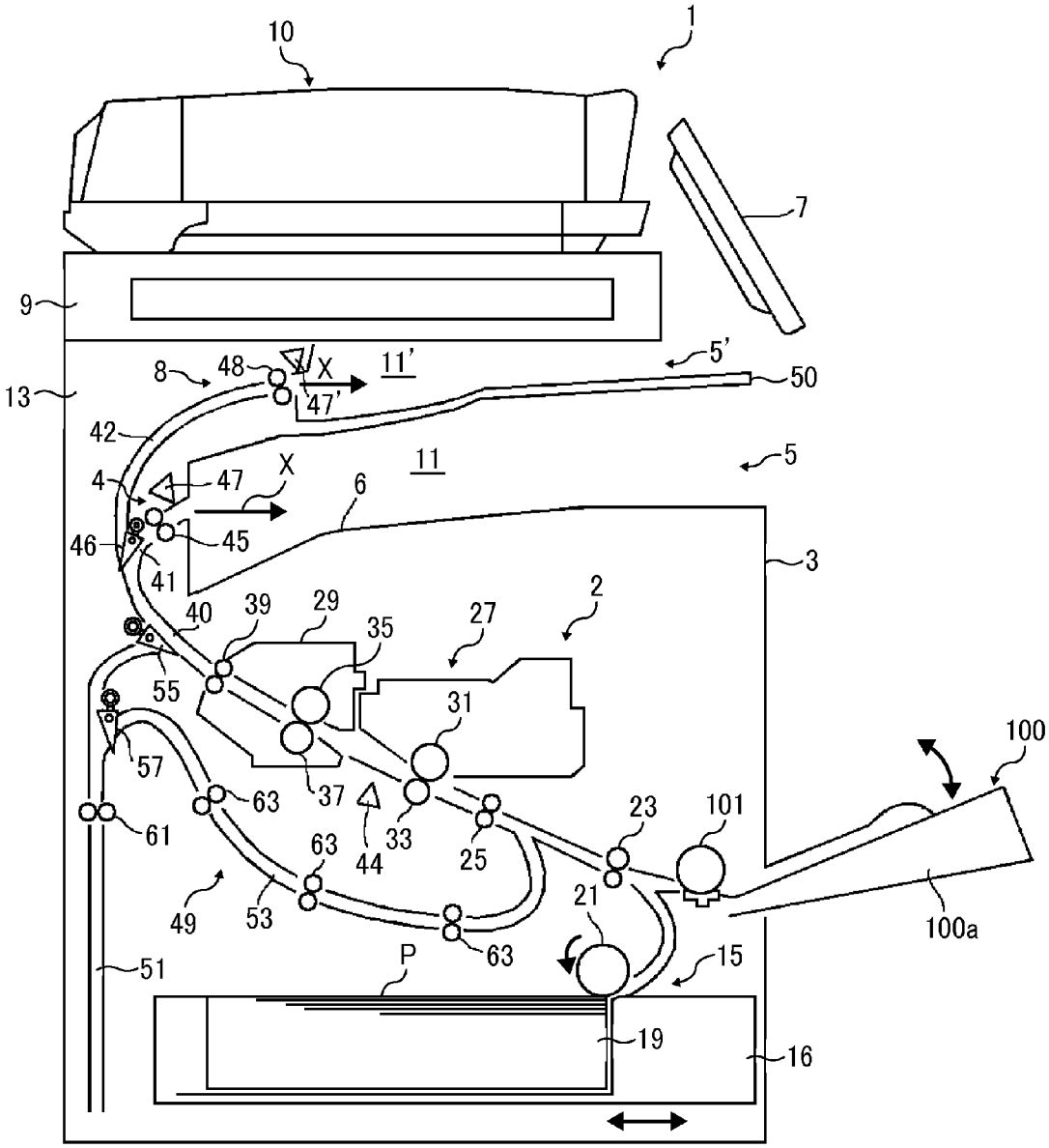
FIG. 2 is a longitudinal sectional view of an example of an internal configuration of an apparatus body of the image forming apparatus illustrated in FIG. 1.

The image forming apparatus 1, as illustrated in FIGS. 1 and 2, includes an image forming unit 2, a first sheet ejection unit 4, a second sheet ejection unit 8, an image reading device 9, an automatic document feeder 10, and an operation unit 7 serving as an operator. The image forming unit 2 is disposed in an image forming apparatus body (hereinafter referred to as an apparatus body) 3 to form an image on a sheet. Each of the first sheet ejection unit 4 and the second sheet ejection unit 8 ejects the sheet with the image formed by the image forming unit 2 in a sheet ejection direction X. The image reading device 9 is disposed such that internal spaces 11 and 11' for sheet ejection and openings 5 and 5' for removal of output sheets are formed above the image forming unit 2. The openings 5 and 5' are formed on a downstream side of the respective internal spaces 11 and 11' in the sheet ejection direction X. The automatic document feeder 10 is disposed on the image reading device 9. The operation unit 7 includes an instruction unit and a display unit for an image forming operation or a document reading operation performed by the image reading device 9.

The image reading device 9 is disposed on the apparatus body 3 via a supporting post 13. A sheet stacking unit 6 is provided on the upper surface of the apparatus body 3 so that sheets ejected from the first sheet ejection unit 4 are stacked, the sheets being recording media on which images are formed. A paper ejection tray 50 is disposed between the sheet stacking unit 6 and the image reading device 9 so that sheets ejected from the second sheet ejection unit 8 are stacked.

As illustrated in FIG. 2, a manual feed tray 100 is provided on the apparatus body 3. The manual feed tray 100 can be opened and closed with respect to the apparatus body 3. A print medium such as a recording sheet, a transfer sheet, and paper on the manual feed tray 100 is fed to the image forming unit 2 by a sheet feed roller 101.

When the manual feed tray 100 is closed with respect to the apparatus body 3 as illustrated in FIG. 1, a back side of the manual feed tray 100 (a side exposed on the front of the image forming apparatus 1) functions as an exterior cover 100*a* of the apparatus body 3.

The apparatus body 3 includes a sheet feed unit 15, an image formation unit 27, and a fixing device 29. The sheet feed unit 15 is provided on a lower side of the apparatus body 3, whereas the image formation unit 27 and the fixing device 29 are provided on an upper side of the apparatus body 3.

The sheet feed unit 15 includes a sheet feed tray 19 on which sheets P are stacked and stored, and a sheet feed roller 21 that rotates in a direction indicated by an arrow illustrated in FIG. 2. The sheet P fed by the rotation of the sheet feed roller 21 is conveyed by a conveyance roller pair 23, and a skew of the sheet P is corrected by a registration roller pair (a positioning roller pair) 25. Then, the sheet P is conveyed to a transfer area of the image formation unit 27 at predetermined timing.

Moreover, as illustrated in FIG. 2, the sheet feed unit 15 includes a sheet feed cassette 16 that can be inserted into or removed from the apparatus body 3. The sheet feed cassette 16 includes a handle 16*a* (see FIG. 1). With the handle 16*a*, the user can insert or remove the sheet feed cassette 16 into or from the apparatus body 3.

For example, in FIG. 1, a sheet width direction indicated by an arrow Y is arranged perpendicular to the sheet ejection direction X.

The image formation unit 27 includes a photoconductor drum 31 serving as an image bearer, and a transfer roller 33 serving as a transfer member.

Moreover, there are known image formation members around the photoconductor drum 31, so that an image is formed by a known electrophotographic process. That is, a charging unit, an exposure unit, a developing unit, a cleaning unit, and a discharge unit are arranged around the photoconductor drum 31. Accordingly, an electrostatic latent image is formed on the photoconductor drum 31, and then rendered visible with toner. Subsequently, the toner image is transferred to the sheet P in a transfer nip formed between a transfer roller 33 and the photoconductor drum 31, the sheet P being conveyed at predetermined timing or fed from the manual feed tray 100.

A sheet sensor 44 serving as a second detector is disposed on a downstream side of the transfer nip in a sheet conveyance direction to detect a sheet that has passed the transfer nip.

The fixing device 29 includes a fixing roller 35 and a pressure roller 37. The fixing device 29 heats and fuses the toner transferred on the sheet P, thereby fixing the toner image on the sheet P. The sheet P with the fixed image is conveyed toward a downstream side in the sheet conveyance direction by a fixing ejection roller pair 39. The sheet P from the sheet feed unit 15 is conveyed by conveyance members including the above-mentioned various rollers while being guided by a first conveyance path 40. The first sheet ejection unit 4 and the second sheet ejection unit 8 are disposed on a downstream side of the first conveyance path 40.

The first sheet ejection unit 4 includes a first ejection conveyance path 41, a first ejection roller pair 45, and a sheet sensor 47. The first ejection conveyance path 41 is connected to the sheet stacking unit 6 by diverging from the first conveyance path 40. The first ejection roller pair 45 is disposed on a downstream end of the first ejection conveyance path 41 in the first sheet ejection unit 4 to eject a sheet P. The sheet sensor 47 serving as a first detector detects the sheet P.

The sheet P is guided to the first ejection conveyance path 41 by a bifurcating claw 46 that is provided in a bifurcation between the first ejection conveyance path 41 and a second ejection conveyance path 42. Then, the sheet P is ejected from the first ejection conveyance path 41 of the first sheet ejection unit 4 to the sheet stacking unit 6.

The second sheet ejection unit 8 includes the second ejection conveyance path 42, a second ejection roller pair 48, and a sheet sensor 47'. The second ejection conveyance path 42 is connected to the paper ejection tray 50 by diverging from the first conveyance path 40 and the first ejection conveyance path 41. The second ejection roller pair 48 is disposed on a downstream end of the second ejection conveyance path 42 to eject the sheet P. The second ejection roller pair 48 ejects the sheet P on which an image is formed, for example, by performing the processes substantially the same as above by the image forming unit 2 based on signals transmitted from an apparatus such as a facsimile machine. The sheet sensor 47 serving as a first detector detects the sheet P.

After the image forming unit 2 forms the image on the sheet P based on the signals from the apparatus such as a facsimile machine, the sheet P is guided to the second ejection conveyance path 42 by bifurcating claws 55 and 46. Then, the sheet P is conveyed and guided to the second ejection roller pair 48 through the second ejection conveyance path 42 in the second sheet ejection unit 8, and is ejected on the paper ejection tray 50 by the second ejection roller pair 48.

A sheet reverse unit 49 is provided between the image formation unit 27 with the fixing device 29 and the sheet feed unit 15. The sheet reverse unit 49 is used when images are formed on two sides of the sheet P.

The sheet reverse unit 49 includes a reverse conveyance path 51 and a sheet refeeding conveyance path 53. The reverse conveyance path 51 is bifurcated from the first conveyance path 40 near a downstream side of the fixing device 29. The sheet refeeding conveyance path 53 is bifurcated from an upper portion of the reverse conveyance path 51. The sheet refeeding conveyance path 53 and the first conveyance path 40 join on an upstream side of the registration roller pair 25.

The bifurcating claw 55 is provided at a bifurcation between the first conveyance path 40 and the reverse conveyance path 51, whereas a bifurcating claw 57 is provided at a bifurcation between the reverse conveyance path 51 and the sheet refeeding conveyance path 53.

When the image forming apparatus 1 is in a duplex mode, the sheet P with an image on one side is guided by the bifurcating claw 55 to the reverse conveyance path 51. The sheet P is switched back and conveyed by a predetermined distance by a conveyance roller pair 61, and then held in a substantially vertical manner by the reverse conveyance path 51. Subsequently, the sheet P is guided to the sheet refeeding conveyance path 53 by the bifurcating claw 57 with a trailing edge thereof being guided as a leading edge. The sheet P guided by the sheet refeeding conveyance path 53 is conveyed by a plurality of roller pairs 63 arranged on the sheet refeeding conveyance path 53, and is fed again toward the transfer area of the image formation unit 27.

Figure 4:
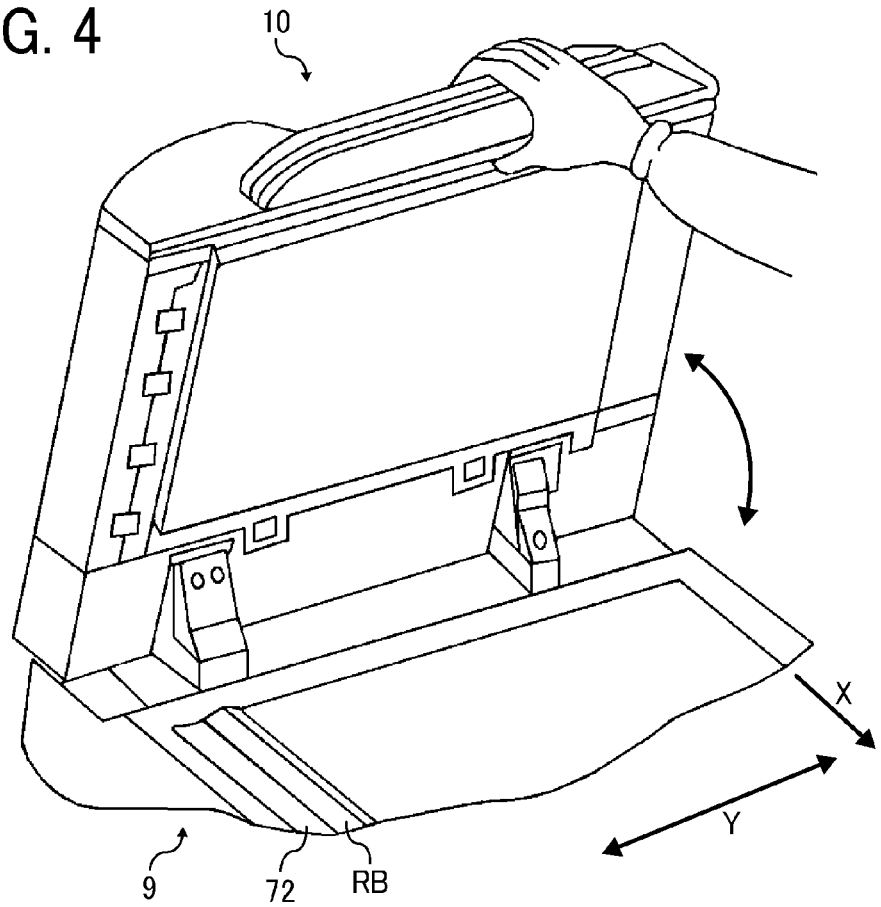
FIG. 4 is a perspective view illustrating a state in which a user holds a holding unit to open and close the automatic document feeder of the image forming apparatus illustrated in FIG. 1.

Next, the image reading device 9 and the automatic document feeder 10 arranged on the image reading device 9 are described. As illustrated in FIG. 4, the automatic document feeder 10, mounted on the top of the image reading device 9, can be opened and closed. The image reading device 9 includes a slit glass (a reading position) 72 on an upper surface thereof. The automatic document feeder 10 enables a document to pass the slit glass 72, so that the image reading device 9 reads the document.

In the automatic document feeder 10, a user can select single-sided mode or duplex mode using the operation unit 7 illustrated in FIG. 1, and operation of the automatic document feeder 10 is controlled according to the selected mode. When documents G containing a plurality of documents arranged in page order are set on a document tray 71 with an image side thereof facing up, a document set detection filler 208 detects the documents G. When the user issues a reading start instruction on the operation unit 7, a pickup roller 207 is controlled to contact the top of the documents G.

Subsequently, a feed roller 209 and a reverse roller 210 separate the documents one by one from the top of the documents G. A conveyance path RA1 is provided between guides 211 and 211*a* to convey the document. An upper cover 10*b* can rotate around an upper cover rotation shaft 233. A conveyance path RB is provided between guides 212 and 212*a* to move the document toward a sheet ejection port 213. If the image forming apparatus 1 is in the single-sided mode, a bifurcating claw 217 is set in a position indicated by a solid line. This enables the document to be ejected to an ejection tray 75 with the image side of the document facing down. On the other hand, if the image forming apparatus 1 is in the duplex mode, the document ejected from the sheet ejection port 213 is switched back. Thus, the document is guided again to the conveyance path RA1 from a trailing edge thereof.

Figure 3:
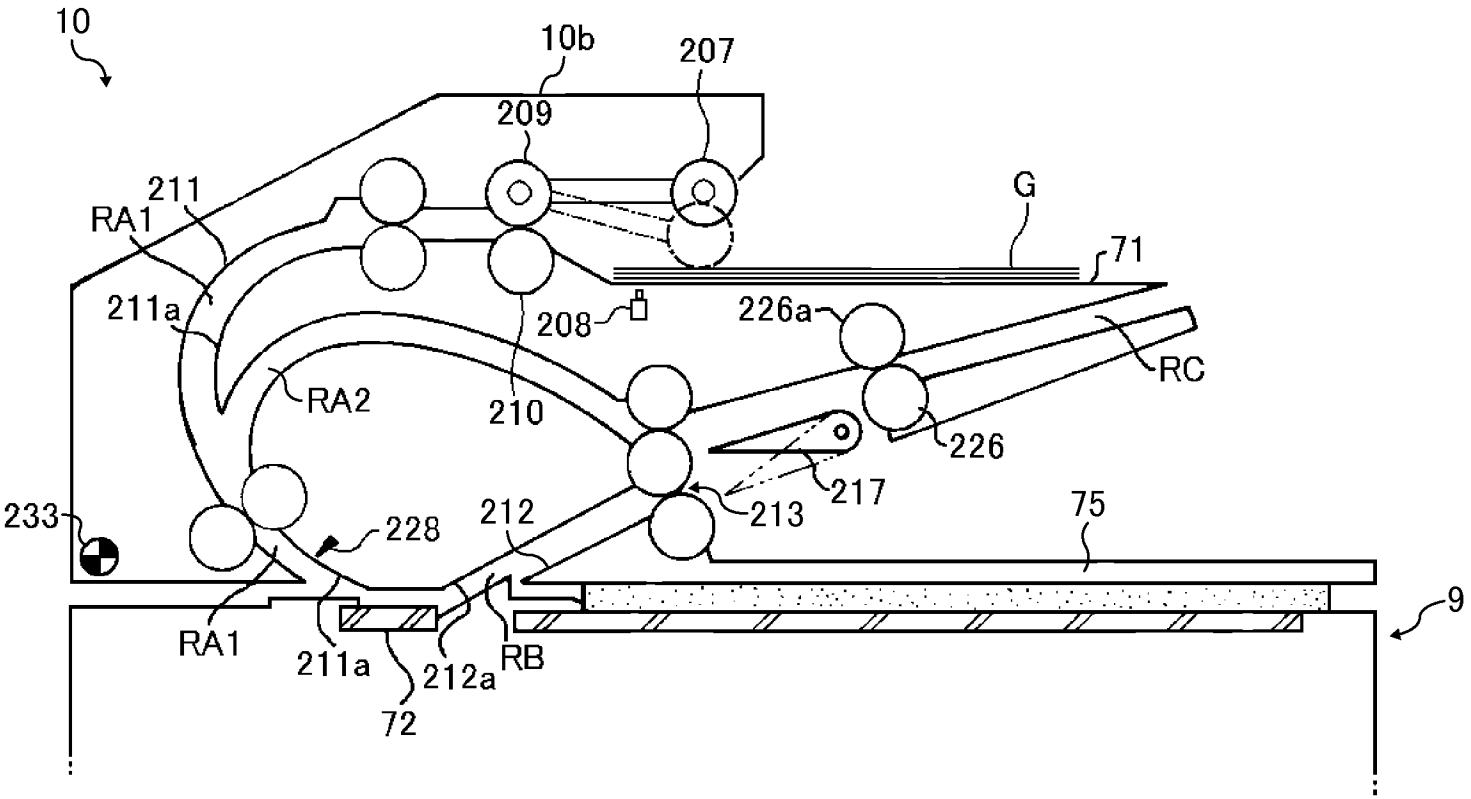
FIG. 3 is a sectional view of an automatic document feeder of the image forming apparatus illustrated in FIG. 1.

The position of the bifurcating claw 217 is shifted to a position indicated by a dotted line illustrated in FIG. 3, so that the document ejected from the sheet ejection port 213 is guided to a switchback conveyance path RC. When the position of the bifurcating claw 217 is shifted to the solid-line position, the document switched back in the switchback conveyance path RC is guided to a conveyance path RA2 from a trailing edge thereof. The conveyance path RA2 is used to convey the switched-back document to the reading position again.

Reverse rollers 226 and 226*a* guide the document conveyed toward the switchback conveyance path RC into the switchback conveyance path RC. Then, the reverse rollers 226 and 226*a* reverse the document to convey it to the conveyance path RA2. A sensor 228 is used to time the leading edge of the document conveyed by a reading roller to coincide with the beginning of document reading.

Figure 5:
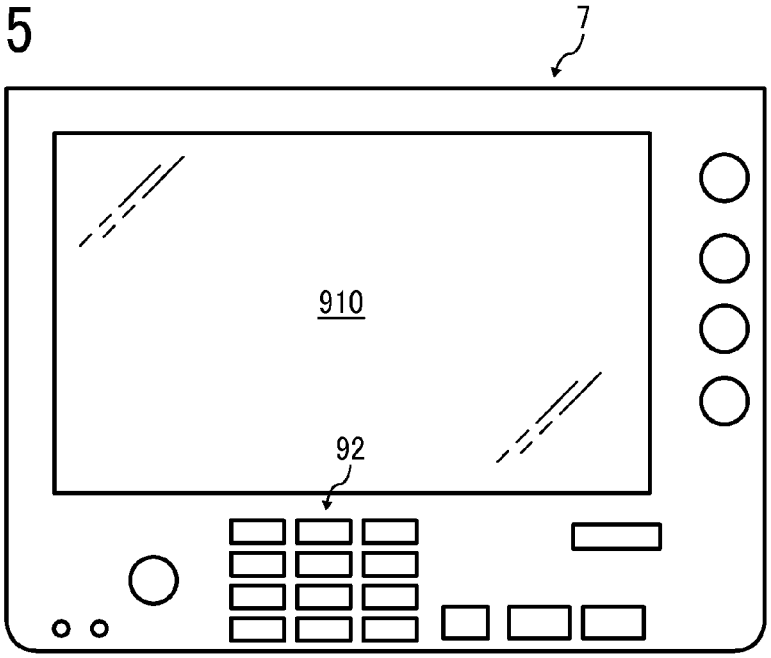
FIG. 5 is a schematic plan view of an operation unit of the image forming apparatus illustrated in FIG. 1.

Next, the operation unit 7 is described in detail with reference to FIGS. 1 and 5. The operation unit 7 is provided on a front side (an operation side) of the image reading device 9. The operation unit 7 is also called an operation panel. The operation unit 7 includes a liquid crystal display 910 serving as a display unit, hard keys 92 including a numeric keypad and a start key, and various light emitting diodes (LEDs). The liquid crystal display 910, the hard keys 92, and the various LEDs are arranged on one surface of the operation unit 7. An operation side of the operation unit 7 is arranged facing the front of the image forming apparatus 1 to enhance visibility and usability for users.

The liquid crystal display 910 includes a touch panel. For example, the touch panel can display a mode selection key for issuing a print instruction (hereinafter called a print job instruction as necessary), and a mode selection key for issuing a print job instruction provided from one of an external terminal 90A and an external terminal 90B, such that the user can make a selection. The external terminal 90A is, for example, a personal computer communicably connected to a receiving unit (e.g., a communication unit 80) serving as a receiver in the image forming apparatus 1. The print job represents an operation, such as a copy operation, a facsimile operation, and a scan operation, to be performed based on one image-forming instruction from the user.

Moreover, the use of the operation unit 7 enables the user to instruct a control unit 81 serving as an operating mode switching unit to switch an operating mode of the image forming apparatus 1 to either a standard mode or a quiet mode. In the standard mode, the image forming apparatus 1 executes an operation under standard operating conditions. In the quiet mode, the image foaming apparatus 1 executes an operation under operating conditions with which operating noise is lower than that in the standard mode. The operating mode may be set according to a request from a user when the image forming apparatus 1 is delivered to the user.

Figure 6:
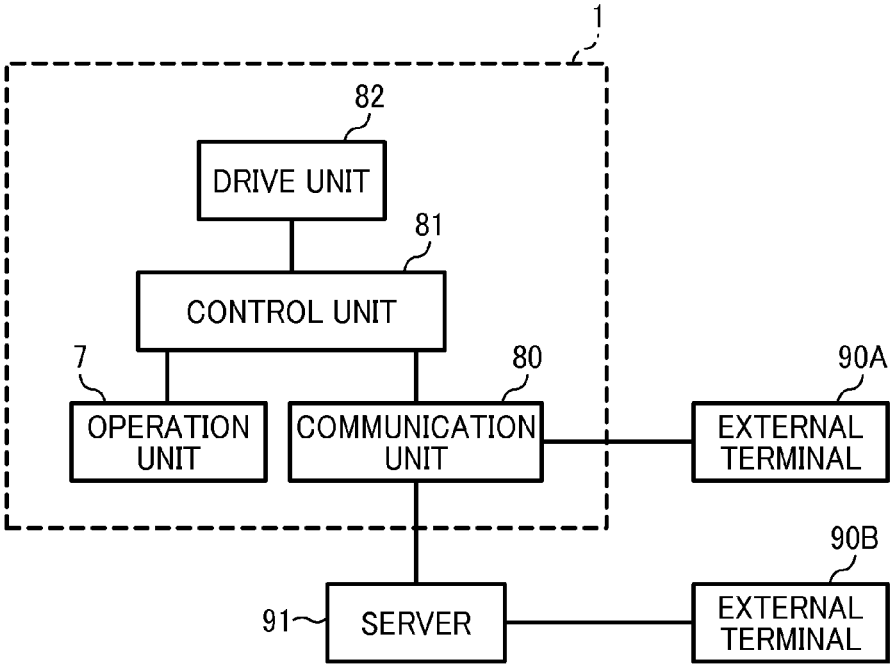
FIG. 6 is a block diagram of hardware executing a print job instruction to the image forming apparatus illustrated in FIG. 1.

Referring to FIG. 6, hardware executing a print job instruction to the image forming apparatus 1 is described. The user operates the operation unit 7 of the image forming apparatus 1 to output a sheet (a print medium) on which an image is formed. Such a sheet to be output from the image foaming apparatus 1 includes, for example, a printout of information stored in a server 91, and a copy output.

From a security standpoint, information stored in the server 91 may be set such that the information should not be printed out immediately even when a print instruction from the external terminal 90 is executed. More particularly, when the user issues a print instruction from the external terminal 90, information of the print instruction is stored in the server 91. Then, the user inputs authentication information via the operation unit 7 or an integrated circuit (IC) card reader provided in the image forming apparatus 1, so that the authentication information is transferred to the server 91 via a network. The server 91 authenticates the information, and replies to the communication unit 80 serving as a receiving unit of the image forming apparatus 1 with an authentication result via the network. Subsequently, the control unit 81 serving as a controller instructs each function of a drive unit 82 of the image forming apparatus 1 to operate. Accordingly, the user can print out confidential information such as business secrets without compromising security.

On the other hand, a document that does not contain confidential information such as business secrets may be set such that the document can be printed out immediately when the user issues a print instruction from the external terminal 90. In such a case, the control unit 81 instructs each function of the drive unit 82 of the image forming apparatus 1 to print out the document immediately. The drive unit 82 drives functions of the sheet feed unit 15, the image forming unit 2, and the first sheet ejection unit 4, for example. In the exemplary embodiment, therefore, the control unit 81 not only serves as an operating mode switching unit for switching the operating mode of the image forming apparatus 1, but also controls driving of each function of the image forming apparatus 1. Alternatively, a plurality of control units may be provided.

Next, a description is given of various controls performed by the control unit 81 when the image forming apparatus 1 executes a function according to an instruction from the user via the operation unit 7. Note that the function to be executed by the image forming apparatus 1 according to the instruction from the user is not limited to a copy function. In the description below, an initial state represents an operating mode state that is initially set, or an operating mode state that is last switched and set. A copy instruction is issued by the user from the operation unit 7. The copy instruction serves as an instruction for execution of a copy function of the image forming apparatus 1. A print instruction is issued by the user from the external terminal 90. The print instruction serves as an instruction for execution of a print function of the image forming apparatus 1. Moreover, each of the copy instruction and the print instruction is a print job instruction that serves as one image-forming instruction from the user. The print job instruction includes, for example, an instruction that an image on page 1 should be formed on 10 sheets of paper, and an instruction that an image on page 10 should be formed on 10 sheets of paper. Instead of the copy instruction, the user may issue an instruction from the operation unit 7 for use of a function of the image forming apparatus 1. Moreover, instead of the print instruction, the user may issue an instruction from the external terminal 90 for use of a function of the image forming apparatus 1.

Figure 7:
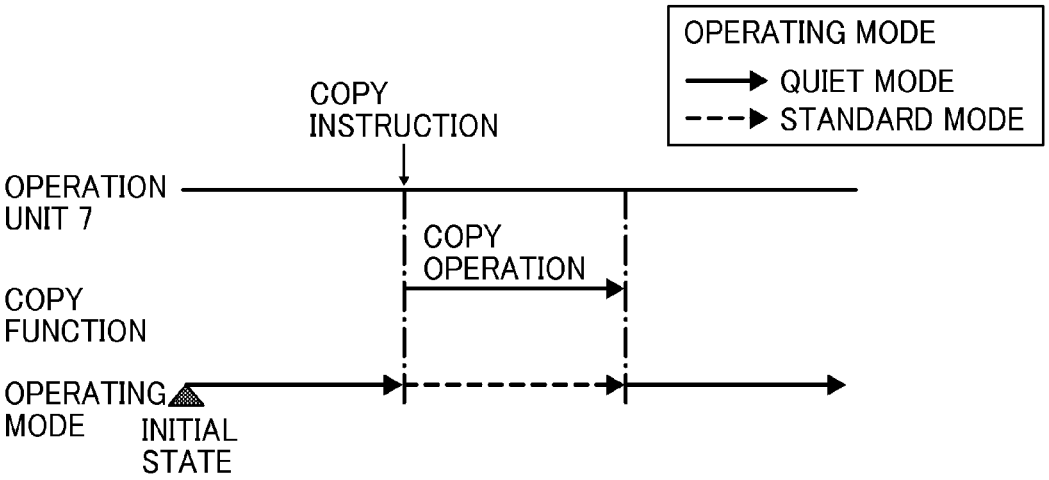
FIG. 7 is a diagram of a first operating mode switching control performed by the image forming apparatus illustrated in FIG. 1.
Figure 13:
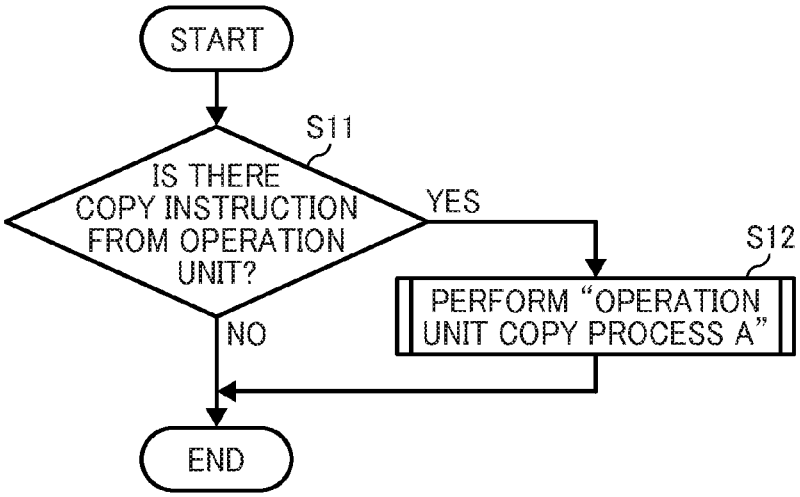
FIG. 13 is a flowchart of the first operating mode switching control performed by the image forming apparatus illustrated FIG. 1.

A first operating mode switching control performed by the control unit 81 is described with reference to FIGS. 7, 13, and 14. Assume that an initial state of the image forming apparatus 1 is a quiet mode. In such a case, the control unit 81 keeps the image forming apparatus 1 in the quiet mode until an instruction for execution of a copy function is issued by the user from the operation unit 7. When the user issues the copy instruction from the operation unit 7, the control unit 81 controls the operating mode of the image forming apparatus 1 to automatically switch to a standard mode. Herein, the user does not switch the operating mode of the image forming apparatus 1 by using the operation unit 7.

The operating mode of the image forming apparatus 1 may be in the standard mode when the user issues the copy instruction from the operation unit 7. In such a case, the control unit 81 keeps the image forming apparatus 1 in the standard mode. That is, when the copy instruction is provided from the operation unit 7, the control unit 81 keeps the image forming apparatus 1 in the standard mode regardless of the operating mode at the time of issue of the copy instruction.

When the image forming apparatus 1 finishes a copy operation based on the copy instruction from the operation unit 7, the control unit 81 controls the operating mode of the image forming apparatus 1 to automatically switch to the quiet mode serving as the initial state.

Such a first operating mode switching control is described with reference to a flowchart illustrated in FIG. 13. In step S10, the image forming apparatus 1 starts the process of the first operating mode switching control when in the quiet mode. In step S11, the image forming apparatus 1 determines whether there is a copy instruction from the operation unit 7. If the image forming apparatus 1 determines that there is no copy instruction (NO in step S11), the process proceeds to step S13 in which the first operating mode switching control ends. On the other hand, if the image forming apparatus 1 determines that there is a copy instruction (YES in step S11), the process is shifted to a subroutine of a copy process based on the instruction from the operation unit 7. In step S12, the copy process subroutine which is described in detail with reference to FIG. 14 is executed. In step S13, the first operating mode switching control ends.

Figure 14:
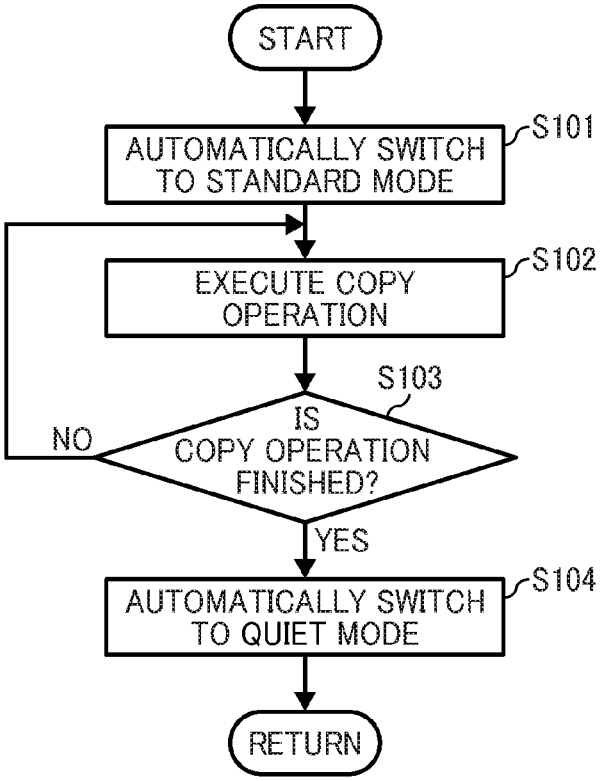
FIG. 14 is a flowchart of a subroutine of "an operation unit copy process A" performed by the image forming apparatus illustrated in FIG. 1.

FIG. 14 is the flowchart illustrating the subroutine of the copy process (also called an operation unit copy process A) based on the instruction from the operation unit 7. In step S100, when a copy instruction is provided from the operation unit 7 while the image forming apparatus 1 is in the quiet mode, the image forming apparatus 1 starts a copy process based on the copy instruction from the operation unit 7. In step S101, the control unit 81 controls the operating mode of the image forming apparatus 1 to automatically switch to the standard mode. In step S102, the image forming apparatus 1 executes the copy operation. Subsequently, in step S103, the image forming apparatus 1 determines whether the copy operation is finished. If the copy operation is not finished (NO in step S103), the process returns to step S102. On the other hand, if the copy operation is finished (YES in step S103), the process proceeds to step S104. In step S104, the control unit 81 controls the operating mode of the image forming apparatus 1 to automatically switch to the quiet mode which is the initial state. In step S105, the subroutine ends and the process returns to the main flow.

According to such a configuration, the user does not need to perform the cumbersome task of switching the operating mode of the image forming apparatus 1 from the quiet mode to the standard mode. This can satisfy the demand of the user who intends to quickly obtain a copied sheet without the cumbersome task. Therefore, such a configuration can provide the image forming apparatus 1 with high convenience for users.

Figure 8A:
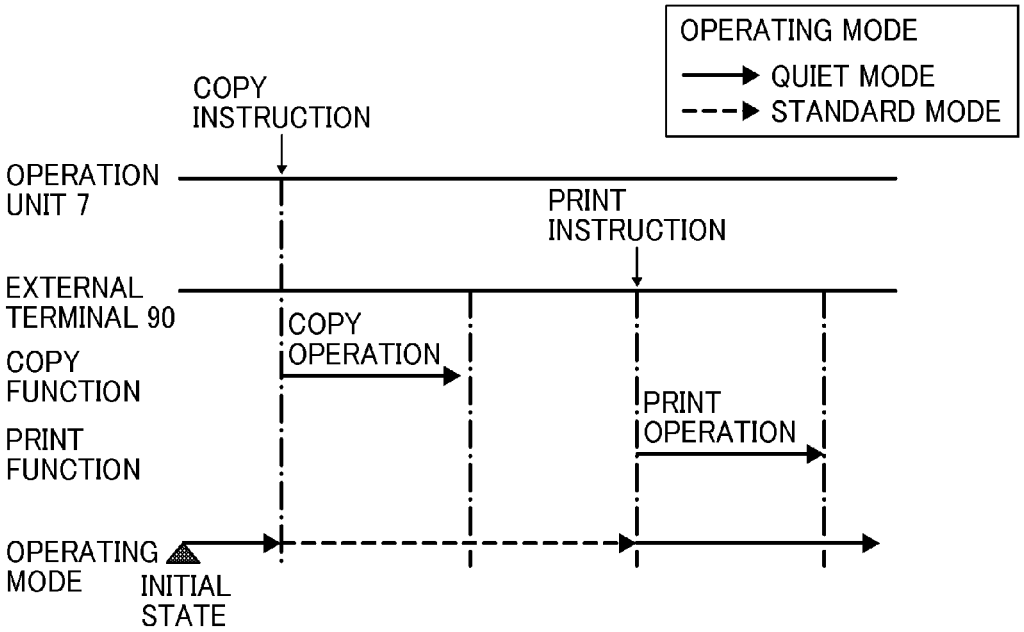
FIGS. 8A and 8B are diagrams of a second operating mode switching control performed by the image forming apparatus illustrated in FIG. 1.

Next, a second operating mode switching control performed by the control unit 81 is described with reference to FIGS. 8A, 8B, 15, and 16. Assume that an initial state of the image forming apparatus 1 is the quiet mode. In such a case, as illustrated in FIG. 8A, the control unit 81 controls the operating mode of the image forming apparatus 1 to remain in the quiet mode until a copy instruction is issued by the user from the operation unit 7. When the user issues the copy instruction from the operation unit 7, the control unit 81 controls the operating mode of the image forming apparatus 1 to automatically switch to the standard mode. Herein, the user does not switch the operating mode of the image forming apparatus 1 by using the operation unit 7.

The operating mode of the image forming apparatus 1 may be a standard mode when the copy instruction is provided from the operation unit 7. In such a case, the control unit 81 keeps the image forming apparatus 1 in the standard mode. That is, when the copy instruction is provided from the operation unit 7, the control unit 81 keeps the image forming apparatus 1 in the standard mode regardless of the operating mode at the time of issue of the copy instruction.

Accordingly, when the image forming apparatus 1 finishes a copy operation based on the copy instruction from the operation unit 7, the control unit 81 keeps the image forming apparatus 1 in the standard mode until a print instruction is provided from the external terminal 90. When the print instruction is provided from the external terminal 90, the control unit 81 controls the operating mode of the image forming apparatus 1 to automatically shift to the quiet mode which is the initial state. Accordingly, the image forming apparatus 1 executes a print operation based on the print instruction from the external terminal 90.

Figure 8B:
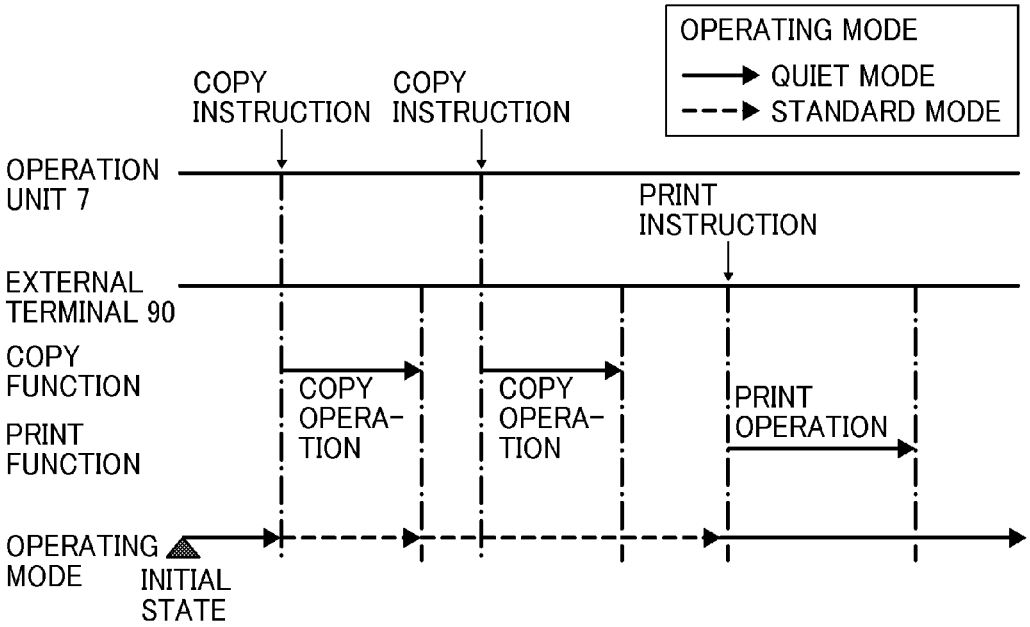

In some cases as illustrated in FIG. 8B, after the image forming apparatus 1 finishes a first copy operation based on a first copy instruction from the operation unit 7, a second copy instruction may be provided from the operation unit 7. In such a case, the control unit 81 may keep the image forming apparatus 1 in the standard mode until a print instruction is provided from the external terminal 90 after the copy operation based on the second copy instruction is finished.

Figure 15:
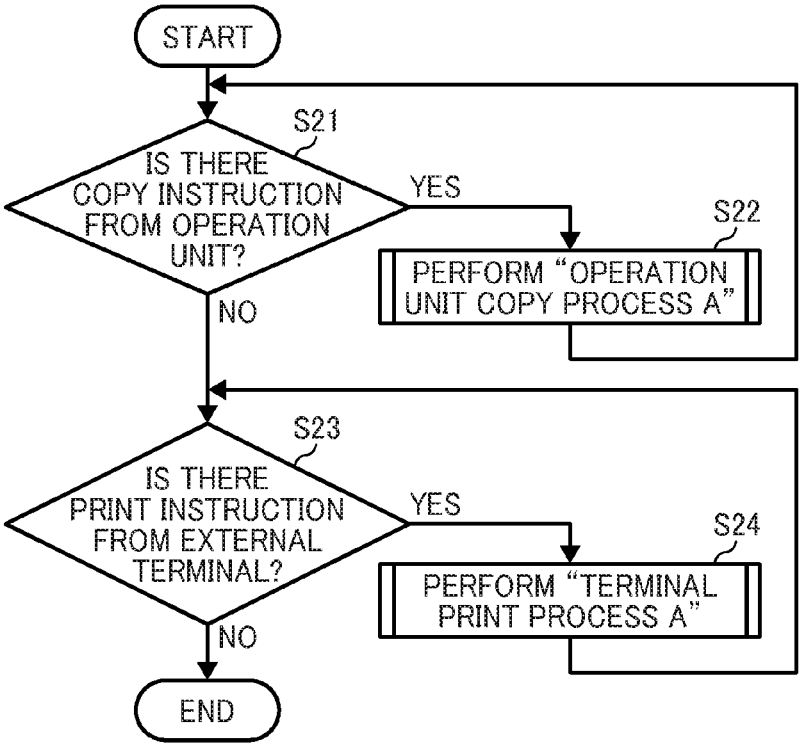
FIG. 15 is a flowchart of the second operating mode switching control performed by the image forming apparatus illustrated FIG. 1.

Next, the second operating mode switching control is described with reference to a flowchart illustrated in FIG. 15. In step S20, the image forming apparatus 1 starts the process of the second operating mode switching control when in the quiet mode. Subsequently, in step S21, the image foaming apparatus 1 determines whether there is a copy instruction from the operation unit 7. If the image forming apparatus 1 determines that there is a copy instruction (YES in step S21), the process proceeds to step S22. In step S22, a subroutine of the operation unit copy process A described above with reference to FIG. 14 is executed. Then, the process returns to step S21. On the other hand, if the image forming apparatus 1 determines that there is no copy instruction from the operation unit 7 (NO in step S21), the process proceeds to step S23 in which the image forming apparatus 1 determines whether there is a print instruction from the external terminal 90. If the image forming apparatus 1 determines that there is a print instruction (YES in step S23), the process proceeds to step S24. In step S24, the image forming apparatus 1 executes a subroutine of a print process (a terminal print process A) based on the instruction from the external terminal 90. Subsequently, the process returns to step S23. On the other hand, if the image forming apparatus 1 determines that there is no print instruction (NO in step S23), the process proceeds to step S25 in which the second operating mode switching control ends.

Figure 16:
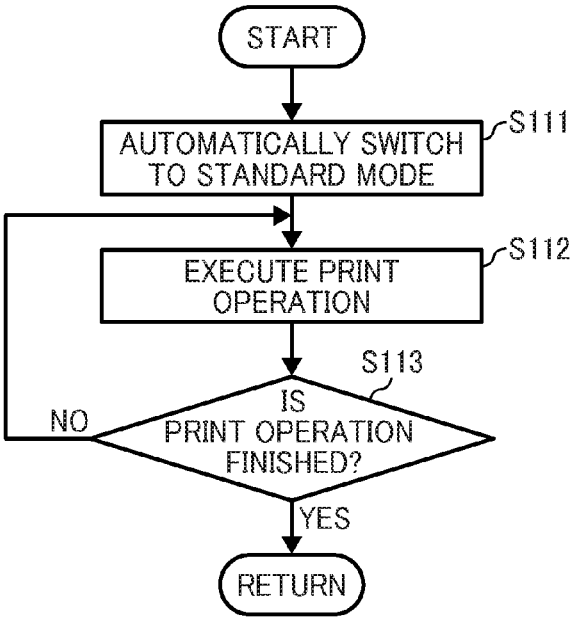
FIG. 16 is a flowchart of a subroutine of "a terminal print process A" performed by the image forming apparatus illustrated in FIG. 1.

FIG. 16 is a flowchart of the subroutine of the print process (the terminal print process A) performed by the image forming apparatus 1 based on the instruction from the external terminal 90. First, in step S110, when a print instruction is issued by a user from the external terminal 90 while the image forming apparatus 1 is in the quiet mode, the image forming apparatus 1 starts the print process (the terminal print process A) based on the instruction from the external terminal 90. Subsequently, in step S111, the control unit 81 controls the operating mode of the image forming apparatus 1 to automatically switch to the standard mode, which is the initial state. In step S112, the image forming apparatus 1 executes the print operation. Subsequently, in step S113, the image forming apparatus 1 determines whether the print operation is finished. If the print operation is not finished (NO in step S113), the process returns to step S112. On the other hand, if the image forming apparatus 1 determines that the print operation is finished (YES in step S113), the process proceeds to step S114 in which the subroutine ends and the process returns to the main flow.

According to such a configuration, the user does not need to perform the cumbersome task of switching the operating mode of the image forming apparatus 1 from the quiet mode to the standard mode. Therefore, this can satisfy the demand of the user who intends to quickly obtain a printed sheet without the cumbersome task. Moreover, the control program can have a simple structure.

Figure 9A:
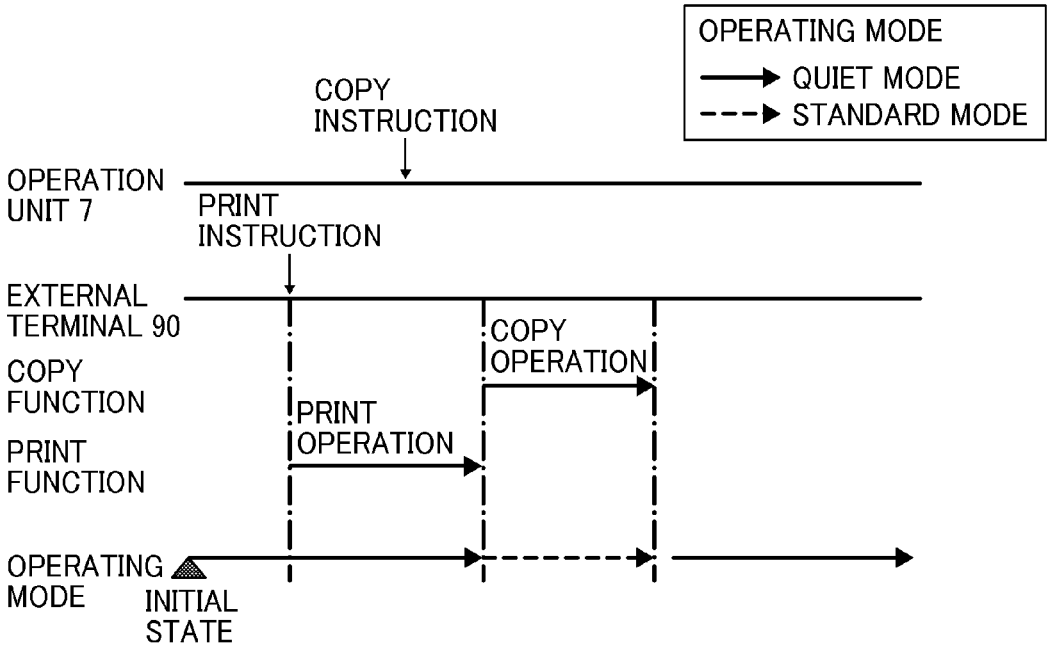
FIGS. 9A and 9B are diagrams of a third operating mode switching control performed by the image forming apparatus illustrated in FIG. 1.

Next, a third operating mode switching control performed by the control unit 81 is described with reference to FIGS. 9A, 9B, 17, and 18. Assume that an initial state of the image forming apparatus 1 is the quiet mode. In such a case, as illustrated in FIG. 9A, when a print instruction is issued by the user from the external terminal 90, the image forming apparatus 1 executes a print operation based on the print instruction from the external terminal 90. Herein, the control unit 81 keeps the image forming apparatus 1 in the quiet mode. A print instruction may be provided from the operation unit 7 while the image forming apparatus 1 is executing the print operation based on the print instruction from the external terminal 90. In such a case, the control unit 81 controls the operating mode of the image forming apparatus 1 to automatically switch to the standard mode when the print operation based on the print instruction from the external terminal 90 is finished. Herein, the user does not switch the operating mode of the image forming apparatus 1 by using the operation unit 7.

When the image forming apparatus 1 finishes the print operation based on the print instruction from the operation unit 7, the control unit 81 controls the operating mode of the image forming apparatus 1 to automatically switch to the quiet mode which is the initial state.

Figure 9B:
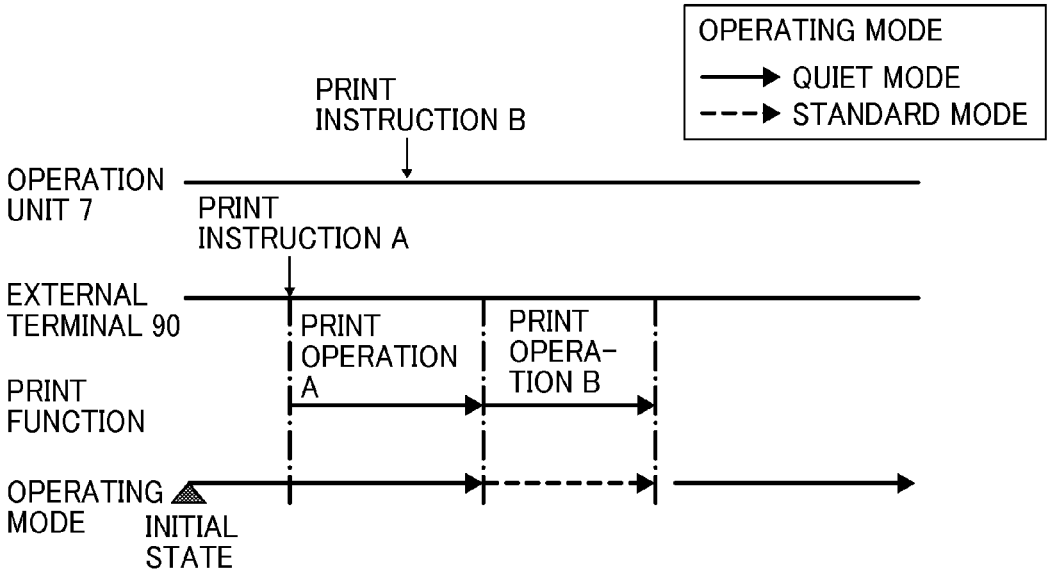

As illustrated in FIG. 9B, the process illustrated in FIG. 9A may be applied to a case where a print instruction is issued by the user from the operation unit 7 instead of the copy instruction. Particularly, assume that an initial state of the image forming apparatus 1 is the quiet mode. In such a case, as illustrated in FIG. 9B, when a print instruction A is provided from the external terminal 90, the image forming apparatus 1 executes a print operation A based on the print instruction A from the external terminal 90. Herein, the control unit 81 keeps the image forming apparatus 1 in the quiet mode. While the image forming apparatus 1 is executing the print operation A based on the print instruction A from the external terminal 90, a print instruction B that information stored in the server 91 should be printed may be provided from the operation unit 7. In such a case, the control unit 81 controls the operating mode of the image forming apparatus 1 to automatically switch to the standard mode when the print operation A based on the print instruction A from the external terminal 90 is finished. Herein, the user does not switch the operating mode of the image forming apparatus 1 by using the operation unit 7.

When the image forming apparatus 1 finishes printing the information stored in the server 91 based on the print instruction B provided from the operation unit 7, the control unit 81 controls the operating mode of the image forming apparatus 1 to automatically switch to the quiet mode, which is the initial state.

Figure 17:
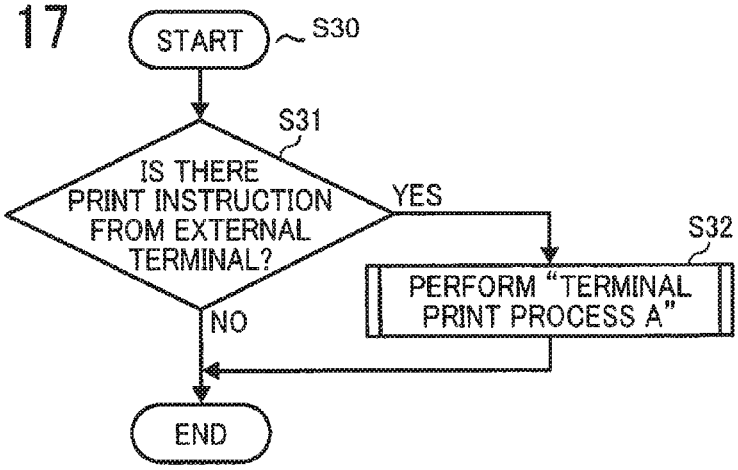
FIG. 17 is a flowchart of the third operating mode switching control performed by the image forming apparatus illustrated FIG. 1.

FIG. 17 is a flowchart illustrating the third operating mode switching control. In step S30, the image forming apparatus 1 starts the process of the third operating mode switching control when in the quiet mode. Subsequently, in step S31, the image forming apparatus 1 determines whether there is a print instruction from the external terminal 90. If there is a print instruction (YES in step S31), the process is shifted to a subroutine of the terminal print process A. In step S32, the image forming apparatus 1 executes the subroutine of the terminal print process A. Subsequently, in step S33, the third operating mode switching control ends. On the other hand, if there is no print instruction (NO in step S31), the process proceeds to step S33 in which the third operating mode switching control ends If a copy instruction or a print instruction is provided from the operation unit 7 while the image forming apparatus 1 is executing the process in the step S52, the process proceeds to step S210 of a flowchart illustrated FIG. 21. In step S210, the image forming apparatus 1 starts an interruption process B. Subsequently, in step S211, the image forming apparatus 1 stops the print operation performed based on the instruction from the external terminal 90. In step S212, the control unit 81 controls the operating mode of the image forming apparatus 1 to automatically switch to the standard mode. In step S213, the image forming apparatus 1 executes an operation based on the copy instruction or the print instruction from the operation unit 7. Subsequently, in step S214, the image forming apparatus 1 determines whether the operation based on the instruction from the operation unit 7 is finished. If the image forming apparatus 1 determines that the operation based on the instruction from the operation unit 7 is not finished (NO in step S214), the process returns to step S213. On the other hand, if image forming apparatus 1 determines that the operation based on the instruction from the operation unit 7 is finished (YES in step S214), the process proceeds to step S215. In step S215, the control unit 81 controls the operating mode of the image forming apparatus 1 to automatically switch to the quiet mode that is the initial state. Subsequently, in step S216, the image forming apparatus 1 resumes the print operation which is stopped in step S211, the print operation being performed based on the instruction from the external terminal 90. In step S217, the process returns to the main flow.

Figure 10A:
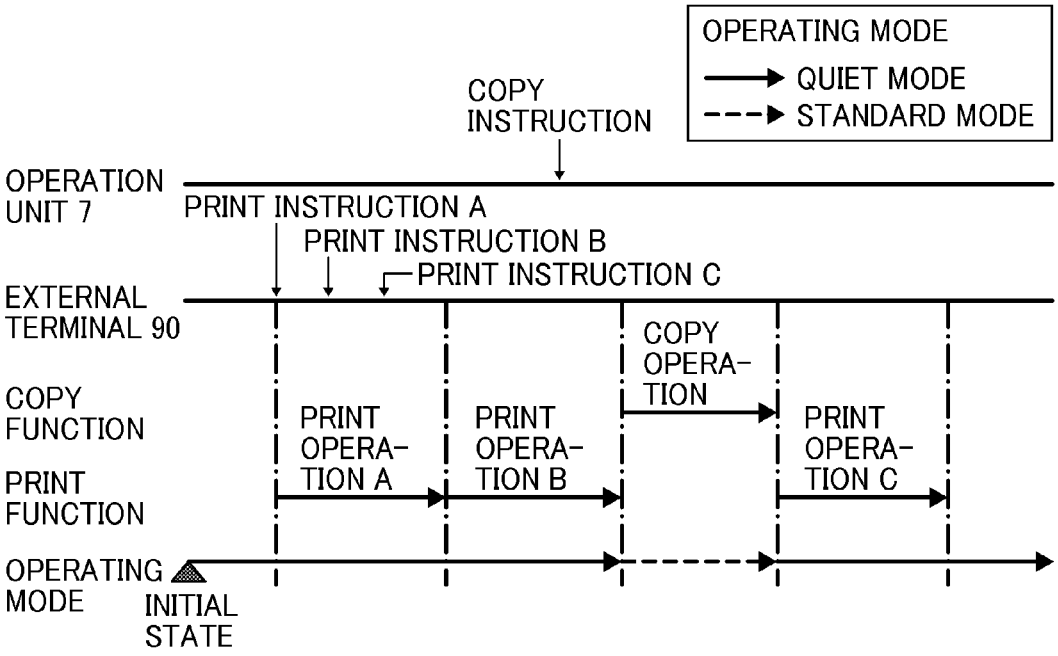
FIGS. 10A and 10B are diagrams of a fourth operating mode switching control performed by the image forming apparatus illustrated in FIG. 1.

According to such a configuration, the user does not need to perform the cumbersome task of switching the operating mode of the image forming apparatus 1 from the quiet mode to the standard mode. This can satisfy the demand of the user who intends to quickly obtain a copied sheet or a printed sheet generated based on the instruction from the operation unit 7. Therefore, such a configuration can provide the image forming apparatus 1 with high convenience for users Next, a fourth operating mode switching control performed by the control unit 81 is described with reference to FIGS. 10A, 10B, 18, and 19. Assume that an initial state of the image forming apparatus 1 is the quiet mode. In such a case, as illustrated in FIG. 10A, when a print instruction A is provided from the external terminal 90, the image forming apparatus 1 executes a print operation A based on the print instruction A. When print instructions B and C are successively provided from the external terminal 90 while the image forming apparatus 1 is executing the print operation A, the image forming apparatus 1 executes a print operation B based on the print instruction B after finishing the print operation A. Herein, the control unit 81 keeps the image forming apparatus 1 in the quiet mode. When a copy instruction is provided from the operation unit 7 while the image forming apparatus 1 is executing the print operation B, the control unit 81 controls the operating mode of the image forming apparatus 1 to automatically switch to the standard mode. Such an automatic switch is performed when the image forming apparatus 1 finishes the print operation B. Herein, the user does not switch the operating mode of the image forming apparatus 1 by using the operation unit 7.

When the image forming apparatus 1 finishes the copy operation based on the copy instruction from the operation unit 7, the control unit 81 controls the operating mode of the image forming apparatus 1 to automatically switch to the quiet mode which is the initial state.

Figure 10B:
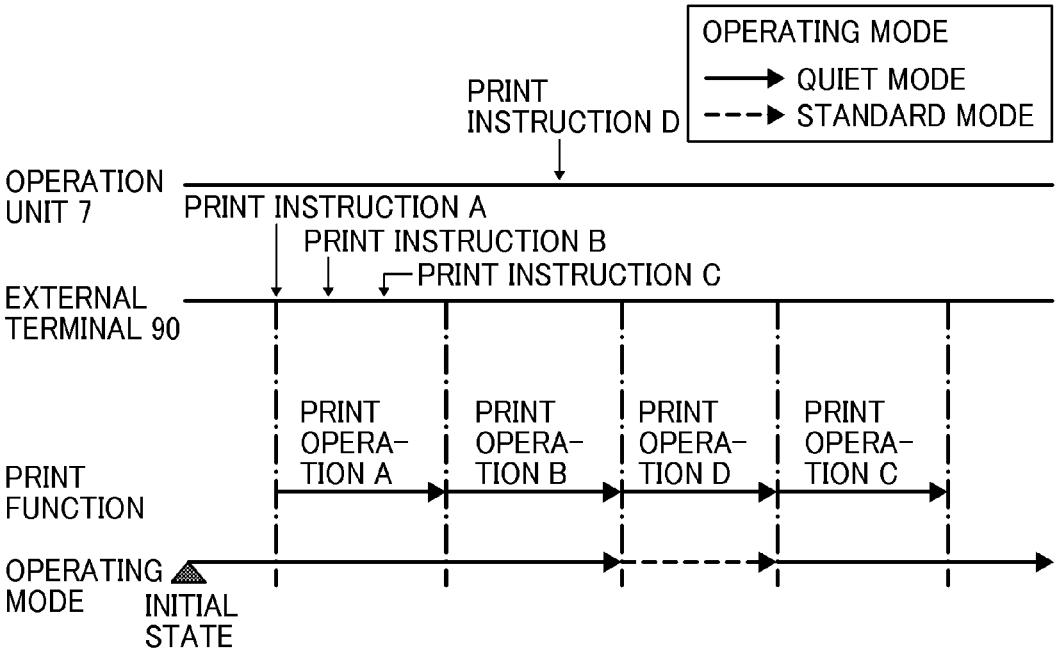

As illustrated in FIG. 10B, the process illustrated in FIG. 10A may be applied to a case where a print instruction D is provided from the operation unit 7 instead of the copy instruction. Particularly, assume that an initial state of the image forming apparatus 1 is the quiet mode. In such a case, as illustrated in FIG. 10B, when a print instruction A is provided from the external terminal 90, the image forming apparatus 1 executes a print operation A based on the print instruction A. When print instructions B and C are successively provided from the external terminal 90 while the image forming apparatus 1 is executing the print operation A, the image forming apparatus 1 executes a print operation B based on the print instruction B after finishing the print operation A. Herein, the control unit 81 keeps the image forming apparatus 1 in the quiet mode.

When the print instruction D is provided from the operation unit 7 while the image forming apparatus 1 is executing the print operation B, the control unit 81 controls the operating mode of the image forming apparatus 1 to automatically switch to the standard mode. Such an automatic switch is performed when the print operation B is finished. Herein, the user does not switch the operating mode of the image forming apparatus 1 by using the operation unit 7.

When the image forming apparatus 1 finishes the print operation D based on the print instruction D, the control unit 81 controls the operating mode of the image forming apparatus 1 to automatically switch to the quiet mode, which is the initial state. Then, the image forming apparatus 1 executes a print operation C based on the print instruction C.

Figure 19:
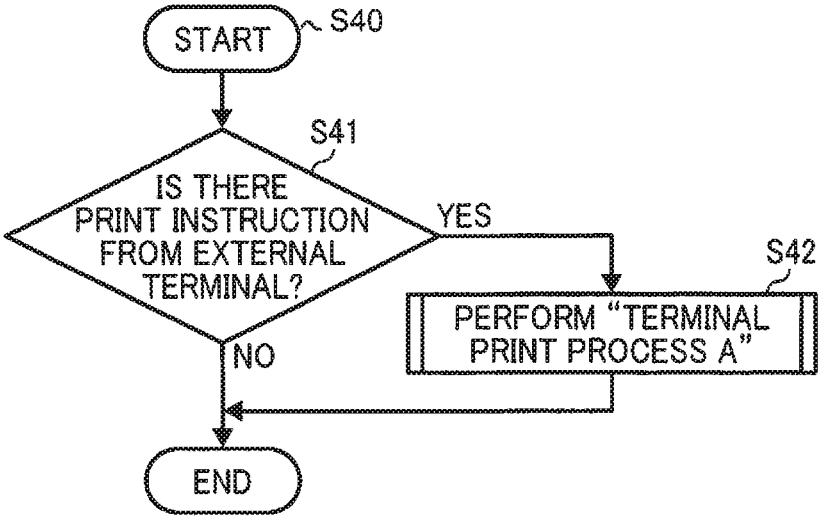
FIG. 19 is a flowchart of the fourth operating mode switching control performed by the image forming apparatus illustrated FIG. 1.

FIG. 19 is a flowchart illustrating the fourth operating mode switching control. In step S40, the image forming apparatus 1 starts the process of the fourth operating mode switching control when in the quiet mode. Subsequently, in step S41, the image forming apparatus 1 determines whether there is a print instruction from the external terminal 90. If there is a print instruction (YES in step S41), the process is shifted to a subroutine of the terminal print process A. In step S42, the image forming apparatus 1 executes the subroutine of the terminal print process A. Then, the process proceeds to step S43 in which the fourth operating mode switching control ends. On the other hand, if there is no print instruction (NO in step S41), the process proceeds to step S43.

Figure 18:
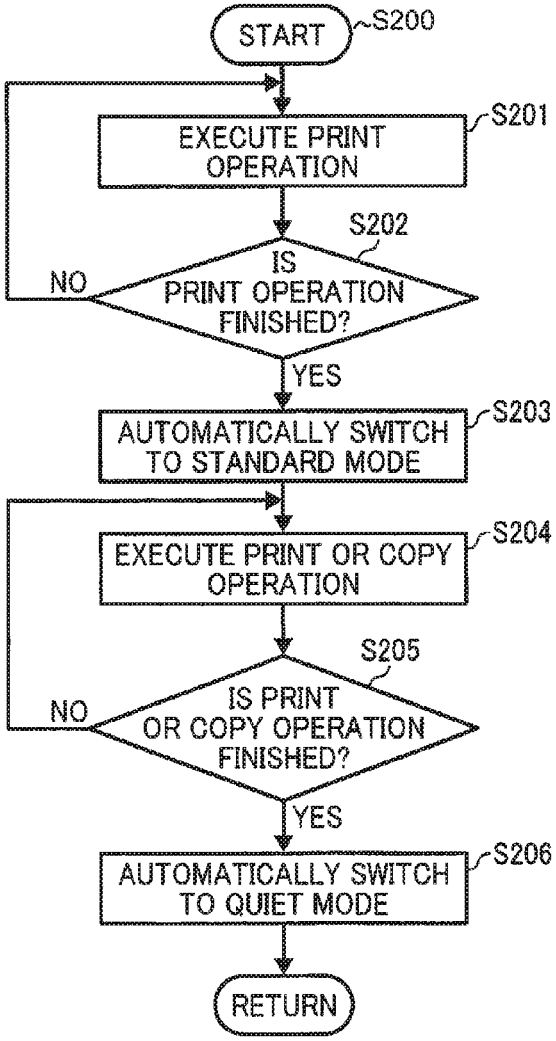
FIG. 18 is a flowchart of "an interruption process A" performed by the image forming apparatus illustrated in FIG. 1.

If a copy instruction or a print instruction is provided from the operation unit 7 while the processes in steps S41 through S42 of the flowchart illustrated in FIG. 19 are being executed, the image forming apparatus 1 executes the interruption process A as illustrated in FIG. 18. When the image forming apparatus 1 finishes the interruption process A, the process returns to the main flow.

Figure 11:
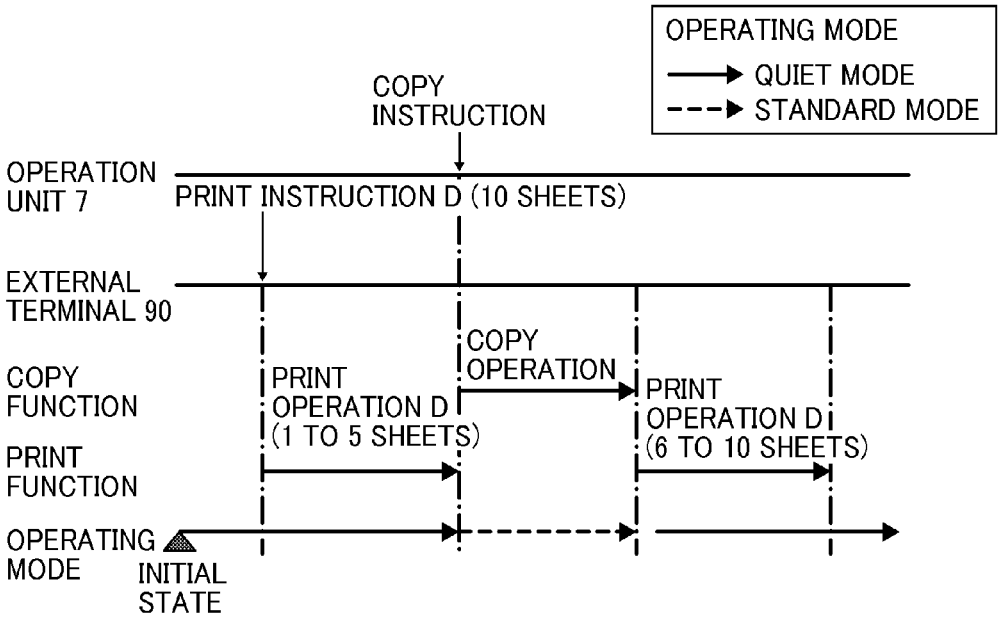
FIG. 11 is a diagram of a fifth operating mode switching control performed by the image forming apparatus illustrated in FIG. 1.

According to such a configuration, even when a plurality of print instructions is provided, the user does not need to perform the cumbersome task of switching the operating mode of the image forming apparatus 1 from the quiet mode to the standard mode. This can satisfy the demand of the user who intends to quickly obtain a copied sheet or a printed sheet generated based on the instruction from the operation unit 7. Therefore, such a configuration can provide the image forming apparatus 1 with high convenience for users Next, a fifth operating mode switching control performed by the control unit 81 is described with reference to FIGS. 11, 20, and 21. Assume that an initial state of the image forming apparatus 1 is the quiet mode. In such a case, as illustrated in FIG. 11, when a print instruction D is provided from the external terminal 90, the image forming apparatus 1 executes a print operation D based on the print instruction D. For example, the print instruction D instructs the image forming apparatus 1 to print page 1 on 10 sheets of paper. Herein, the control unit 81 keeps the image forming apparatus 1 in the quiet mode.

When a copy instruction is provided from the operation unit 7 while the image forming apparatus 1 is printing a fifth sheet of the print operation D, the image forming apparatus 1 forcibly stops the print operation D after finishing printing the fifth sheet of the print operation D. Meanwhile, the control unit 81 controls the operating mode of the image forming apparatus 1 to automatically switch to the standard mode. The image forming apparatus 1 executes a copy operation based on the copy instruction from the operation unit 7. Herein, the user does not switch the operating mode of the image forming apparatus 1 by using the operation unit 7.

When the image forming apparatus 1 finishes the copy operation based on the copy instruction from the operation unit 7, the control unit 81 controls the operating mode of the image forming apparatus 1 to automatically switch to the quiet mode which is the initial state. Then, the image forming apparatus 1 executes the remaining operation of the print operation D.

Figure 20:
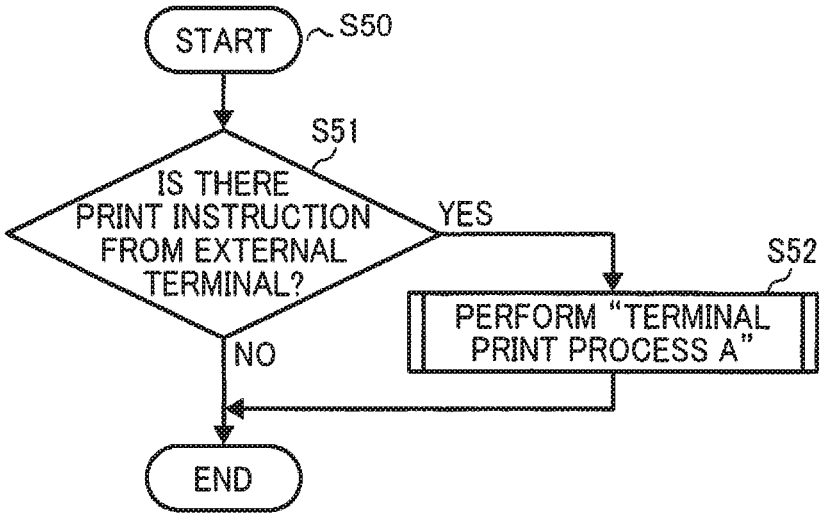
FIG. 20 is a flowchart of the fifth operating mode switching control performed by the image forming apparatus illustrated FIG. 1.

FIG. 20 is a flowchart illustrating the fifth operating mode switching control. In step S50, the image forming apparatus 1 starts the process of the fifth operating mode switching control when in the quiet mode. In step S51, the image forming apparatus 1 determines whether there is a print instruction from the external terminal 90. If there is a print instruction (YES in step S51), the process is shifted to a subroutine of the terminal print process A. In step S52, the image forming apparatus 1 executes the subroutine of the terminal print process A. Then, in step S53, the fifth operating mode switching control ends. On the other hand, if there is no print instruction (NO in step S51), the process proceeds to step S53.

Figure 21:
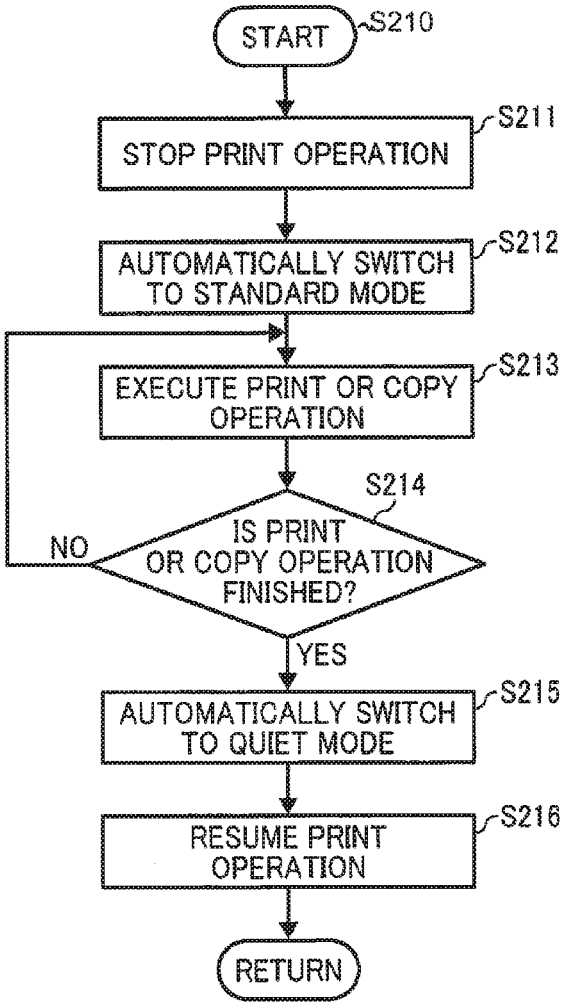
FIG. 21 is a flowchart of "an interruption process B" performed by the image forming apparatus illustrated in FIG. 1.

If a copy instruction or a print instruction is provided from the operation unit 7 while the image forming apparatus 1 is executing the process in the step S52, the process proceeds to step S210 of a flowchart illustrated FIG. 21. In step S210, the image forming apparatus 1 starts an interruption process B. Subsequently, in step S211, the image forming apparatus 1 stops the print operation performed based on the instruction from the external terminal 90. In step S212, the control unit 81 controls the operating mode of the image forming apparatus 1 to automatically switch to the standard mode. In step S213, the image forming apparatus 1 executes an operation based on the copy instruction or the print instruction from the operation unit 7. Subsequently, in step S214, the image forming apparatus 1 determines whether the operation based on the instruction from the operation unit 7 is finished. If the image forming apparatus 1 determines that the operation based on the instruction from 7 is not finished (NO in step S214), the process returns to step S213. On the other hand, if image forming apparatus 1 determines that the operation based on the instruction from the operation unit 7 is finished (YES in step S214), the process proceeds to step S215. In step S215, the control unit 81 controls the operating mode of the image forming apparatus 1 to automatically switch to the quiet mode that is the initial state. Subsequently, in step S216, the image forming apparatus 1 resumes the print operation which is stopped in step S211, the print operation being performed based on the instruction from 90. In step S217, the process returns to the main flow.

According to such a configuration, even when the image forming apparatus 1 is executing a print operation in the quiet mode, the user does not need to perform the cumbersome task of switching the operating mode of the image forming apparatus 1 from the quiet mode to the standard mode. Therefore, this can satisfy the demand of the user who intends to quickly obtain a copied sheet.

Figure 12A:
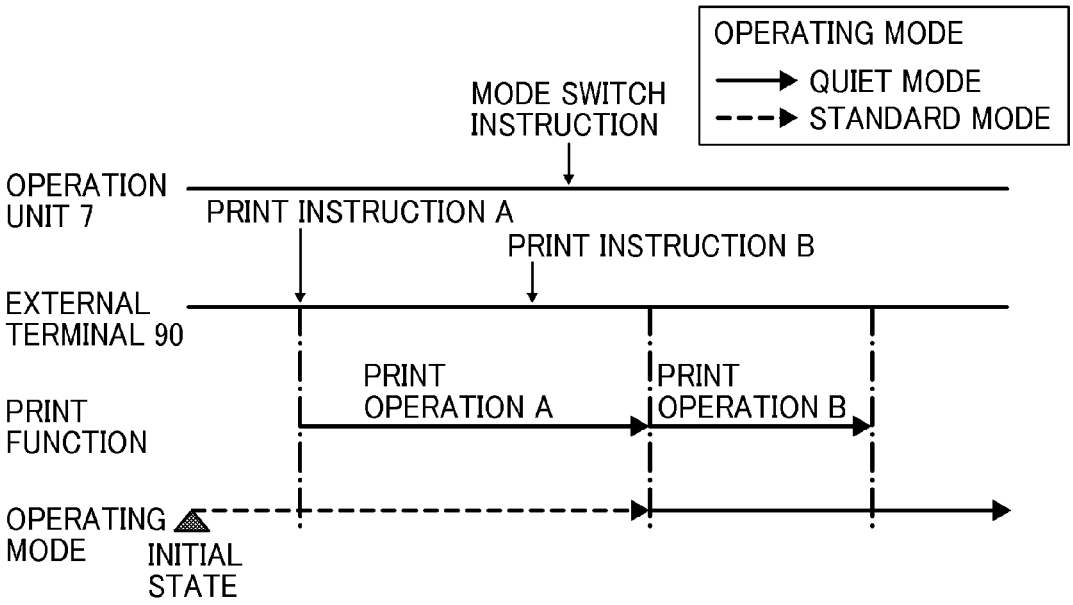
FIGS. 12A and 12B are diagrams of a sixth operating mode switching control performed by the image forming apparatus illustrated in FIG. 1.

Next, a sixth operating mode switching control performed by the control unit 81 is described with reference to FIGS. 12A, 12B, 22, 23, and 24. Assume that an initial state of the image forming apparatus 1 is the standard mode. In such a case, as illustrated in FIG. 12A, when a print instruction A is provided from the external terminal 90, the image forming apparatus 1 executes a print operation A based on the print instruction A. Herein, the control unit 81 keeps the image forming apparatus 1 in the standard mode.

In FIG. 12A, while the image forming apparatus 1 is executing the print operation A, a print instruction B and a mode switch instruction for a switch to the quiet mode are successively provided from the external terminal 90 and the operation unit 7, respectively. In such a case, the control unit 81 controls the operating mode of the image forming apparatus 1 to switch to the quiet mode after the image forming apparatus 1 finishes the print operation A. Then, the image forming apparatus 1 executes a print operation B based on the print instruction B.

Figure 12B:
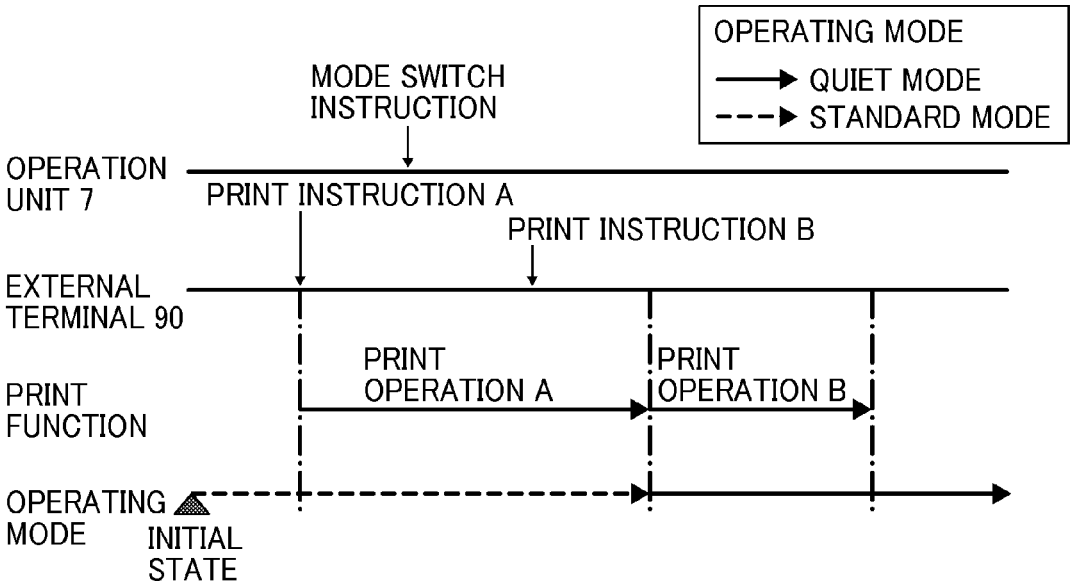

As illustrated in FIG. 12B, the process illustrated in FIG. 12A may be applied to a case where the mode switch instruction for a switch to the quiet mode is provided from the operation unit 7 at different time. Particularly, assume that an initial state of the image forming apparatus 1 is the standard mode. In such a case, as illustrated in FIG. 12B, when a print instruction A is provided from the external terminal 90, the image forming apparatus 1 executes a print operation A based on the print instruction A. Herein, the control unit 81 keeps the image forming apparatus 1 in the standard mode.

In FIG. 12B, while the image forming apparatus 1 is executing the print operation A, a mode switch instruction for a switch to the quiet mode and a print instruction B are successively provided from the operation unit 7 and the external terminal 90, respectively. In such a case, the control unit 81 controls the operating mode of the image forming apparatus 1 to switch to the quiet mode after the image forming apparatus 1 finishes the print operation A. Then, the image forming apparatus 1 executes a print operation B based on the print instruction B.

Figure 22:
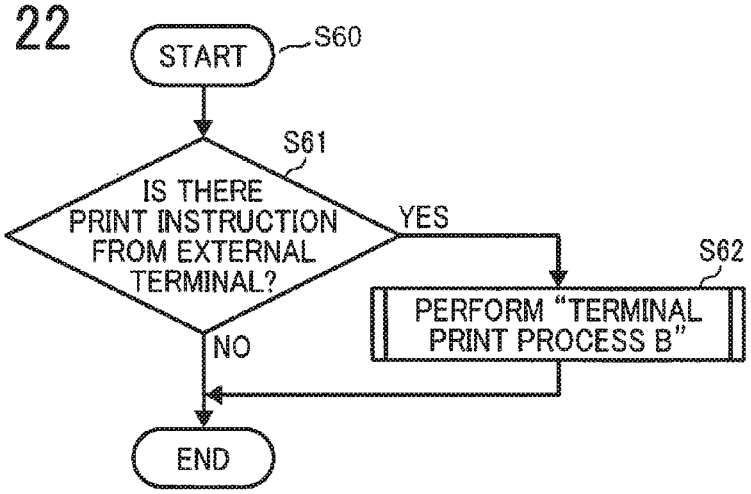
FIG. 22 is a flowchart of the sixth operating mode switching control performed by the image forming apparatus illustrated FIG. 1.

FIG. 22 is a flowchart illustrating the sixth operating mode switching control. In step S60, the image forming apparatus 1 starts the process of the sixth operating mode switching control when in the standard mode. In step S61, the image forming apparatus 1 determines whether there is a print instruction from the external terminal 90. If the image forming apparatus 1 determines that there is a print instruction (YES in step S61), the process is shifted to a subroutine of a print process (a terminal print process B). In step S62, the image forming apparatus 1 performs the terminal print process B based on the instruction from the external terminal 90. The terminal print process B is described in detail below with reference to FIG. 23. In step S63, the six operating mode switching control ends. On the other hand, if there is no print instruction (NO in step S61), the process proceeds to step S63.

Figure 23:
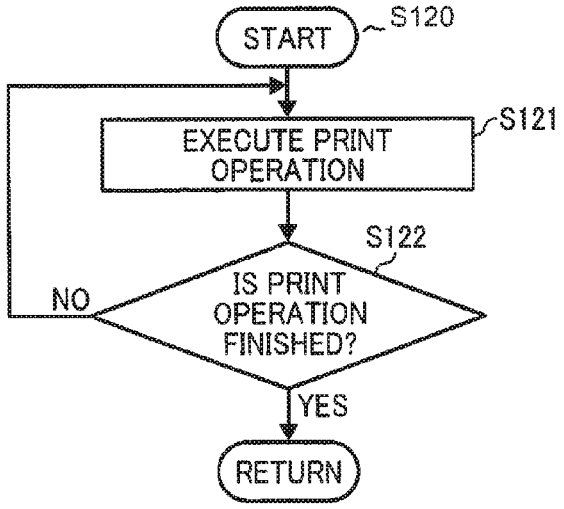
FIG. 23 is a flowchart of "a terminal print process B" performed by the image forming apparatus illustrated in FIG. 1.

FIG. 23 is a flowchart illustrating the subroutine of the print process (the terminal print process B) performed by the image forming apparatus 1 in the standard mode. The terminal print process B is performed based on the instruction from the external terminal 90. In step S120, when there is a print instruction from the external terminal 90, the image forming apparatus 1 starts a print process in the standard mode based on the instruction from the external terminal 90. In step S121, the image forming apparatus 1 executes the print operation. Subsequently, in step S122, the image forming apparatus 1 determines whether the print operation is finished. If the image forming apparatus 1 determines that the print operation is not finished (NO in step S122), the process returns to step S121. On the other hand, if the print operation is finished (YES in step S122), the process proceeds to step S123. In step S123, the subroutine ends, and the process returns to the main flow.

Figure 24:
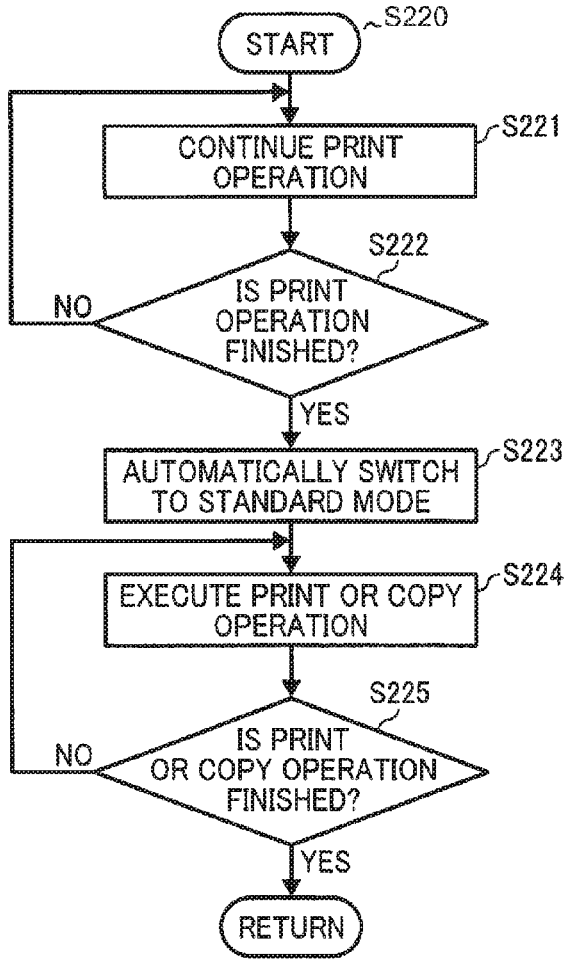
FIG. 24 is a flowchart of "an interruption process C" performed by the image forming apparatus illustrated in FIG. 1.

If a mode switch instruction is provided from the operation unit 7 while the processes in steps S61 through S62 of the flowchart illustrated in FIG. 22 are being executed, a process in step S220 of a flowchart as illustrated in FIG. 24 begins. In step S220, the image forming apparatus 1 executes an interruption process C. Subsequently, in step S221, the image forming apparatus 1 continues the print operation in the quiet mode based on the instruction from the external terminal 90. In step S222, the image forming apparatus 1 deter mines whether the print operation based on the instruction from the external terminal 90 is finished. If the image forming apparatus 1 determines that the print operation based on the instruction from the external terminal 90 is not finished (NO in step S222), the process returns to step S221. On the other hand, if the print operation based on the instruction from the external terminal 90 is finished (YES in step S222), the process proceeds to step S223. In step S223, the control unit 81 controls the operating mode of the image forming apparatus 1 to automatically switch to the standard mode. Then, in step S224, the image forming apparatus 1 executes an operation based on a copy instruction or a print instruction from the operation unit 7. In step S225, the image forming apparatus 1 determines whether the operation based on the instruction from the operation unit 7 is finished. If the image forming apparatus 1 determines that the operation based on the instruction from the operation unit 7 is not finished (NO in step S225), the process returns to step S224. On the other hand, if the operation based on the instruction from the operation unit 7 is finished (YES in step S225), the process proceeds to step S226. In step S226, the interruption process C ends, and the process returns to the main flow.

When the image forming apparatus 1 in the standard mode executes the print operations based on a plurality of instructions, operating noise is generated for a long time in spite of the absence of the user at the image forming apparatus 1. Such operating noise may annoy a person or persons near the image forming apparatus 1. Consequently, when the image forming apparatus 1 executes the print operation in the standard mode, the person near the image forming apparatus 1 may demand lower noise. In such a case, the above configuration can satisfy the demand of the person.

Next, a description is given of timing at which the control unit 81 illustrated in FIG. 6 switches an operating mode of the image forming apparatus 1. In particular, when the image forming apparatus 1 is executing a print job in a current operating mode, the control unit 81 waits for the print job to be finished. The control unit 81 switches the operating mode of the image forming apparatus 1 after a predetermined time period has elapsed from the finish of the print job.

A first operating mode switch timing is first described in detail. Before switching the operating mode of the image forming apparatus 1, the control unit 81 checks if there is any sheet being conveyed inside the image forming apparatus 1. After confirming that the conveyed sheet is ejected outside the image forming apparatus 1, the control unit 81 switches the operating mode at the first operating mode switch timing.

Particularly, when switching the operating mode, the control unit 81 causes the sheet feed roller 21 to stop rotating or causes the sheet feed roller 21 to be separated from a sheet stacked on the sheet feed cassette 16. This temporarily stops feeding a new sheet. When the sheet sensor 47 or 47' detects a trailing edge of the sheet conveyed by the corresponding first or second ejection roller pair 45 or 48, the control unit 81 executes the operating mode switching control. This enables the sheet feed roller 21 to rotate or contact the sheet stacked on the sheet feed cassette 16 to start feeding a new sheet.

Figure 25:
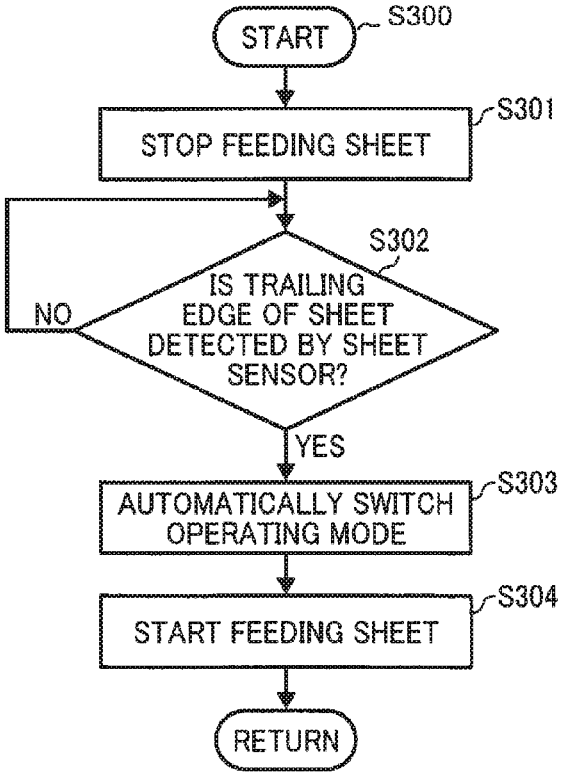
FIG. 25 is a flowchart of first operating mode switch timing of the image forming apparatus illustrated in FIG. 1.

Next, the first operating mode switch timing is described with reference to a flowchart of FIG. 25. In step S300, the control unit 81 starts the first operating mode switching control. In step S301, the control unit 81 stops feeding a new sheet. Subsequently, in step S302, the control unit 81 determines whether the sheet sensor 47 or 47' has detected a trailing edge of the sheet conveyed by the corresponding first or second ejection roller pair 45 or 48. If the sheet sensor 47 or 47' has not detected the trailing edge of the sheet conveyed by the corresponding first or second ejection roller pair 45 or 48 (NO in step S302), the control unit 81 allows the sheet sensor 47 or 47' to continue the detection operation until detection of the trailing edge of the sheet. If the sheet sensor 47 or 47' detects the trailing edge of the sheet conveyed by the corresponding first or second ejection roller pair 45 or 48 (YES in step S302), the process proceeds to step S303. In step S303, the control unit 81 controls the operating mode of the image forming apparatus 1 to automatically switch between the standard mode and the quiet mode. In step S304, the control unit 81 starts feeding a sheet. In step S305, the process returns to the main flow.

Next, the second operating mode switch timing is described in detail. Before switching the operating mode of the image forming apparatus 1, the control unit 81 checks if a sheet being conveyed has passed the image formation unit 27 of the image forming apparatus 1. Upon confirming that the sheet has passed the image formation unit 27, the control unit 81 executes the operating mode switching control at the second operating mode switch timing.

In particular, when switching the operating mode, the control unit 81 causes the sheet feed roller 21 to stop rotating or causes the sheet feed roller 21 to be separated from a sheet stacked on the sheet feed cassette 16. This temporarily stops feeding a new sheet. When the sheet sensor 44 detects a trailing edge of a sheet on which an image is formed, the control unit 81 executes the operating mode switching control. This enables the sheet feed roller 21 to rotate or contact the sheet stacked on the sheet feed cassette 16 to start feeding a new sheet.

Figure 26:
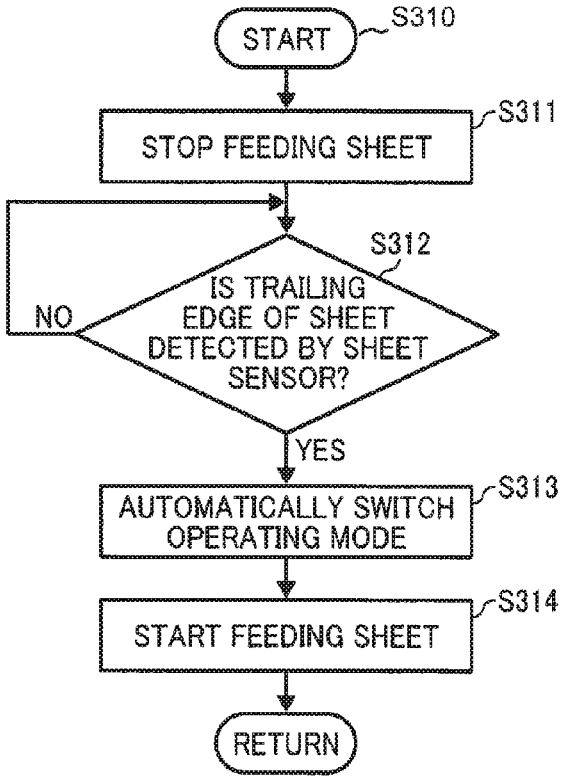
FIG. 26 is a flowchart of second operating mode switch timing of the image forming apparatus illustrated in FIG. 1.

Next, the second operating mode switch timing is described with reference to a flowchart of FIG. 26. In step S310, the control unit 81 starts the second operating mode switch control. In step S311, the control unit 81 stops feeding a new sheet. Subsequently, in step S312, the control unit 81 determines whether the sheet sensor 44 has detected a trailing edge of a sheet on which an image is formed. If the control unit 81 determines that the sheet sensor 44 has not detected the trailing edge of the sheet with the image (NO in step S312), the control unit 81 allows the sheet sensor 44 to continue the detection operation until detection of the trailing edge of the sheet. In step S313, if the sheet sensor 44 detects the trailing edge of the sheet (YES in step S312), the control unit 81 controls the operating mode of the image forming apparatus 1 to automatically switch between the standard mode and the quiet mode. Subsequently, in step S314, the control unit 81 starts feeding a sheet. In step S315, the process returns to the main flow.

Accordingly, the sheet feeding is stopped for a predetermined time period before the control unit 81 executes the operating mode switching control. This prevents a sheet from contacting another sheet. That is, the above configuration can prevent the contact between sheets due to a difference in sheet conveyance speeds caused by a difference in operating modes.

Next, a description is given of a destination of a sheet to be output when the control unit 81 executes the operating mode switching control. The control unit 81 controls the bifurcating claw 46 to move at the above operating mode switch timing, so that the output destination of the sheet is changed to the sheet stacking unit 6 or the paper ejection tray 50.

Such a configuration can prevent the user from mistakenly acquiring an ejected sheet when the operating mode of the image forming apparatus 1 is changed. The output destination of the sheet may not necessarily be changed. In such a case, the user visually checks the ejected sheet before acquiring it.

FIG. 27 illustrates fan control operations performed when the image forming apparatus is in standard mode and quiet mode. The image forming apparatus 1 includes a plurality of fans to cool, for example, the fixing device 29, a wiring device, the developing unit of the image formation unit 27, a toner supply device, a power supply unit (PSU), a controller, and the sheet feed unit 15. Operating noise of each of these fans may annoy a person or persons near the image forming apparatus 1. In the exemplary embodiment, a mass flow rate or the speed of the fan can be adjusted according to an operating mode of the image forming apparatus 1. In FIG. 27, the term "high speed" represents a mass flow rate or the speed of the fan when the image forming apparatus 1 is in the standard mode, whereas the term "low speed" represents a mass flow rate or the speed of the fan that is fewer than that when the image forming apparatus 1 is in the standard mode.

The fan arranged toward each of the fixing device 29, the PSU, and the controller is described. When the image forming apparatus 1 in the quiet mode needs to increase temperature thereof, the fan is set to high speed. If the fan can be operated at low speed, the fan is set to low speed when possible. On the other hand, when the image forming apparatus 1 is in the standard mode, the fan is set to high speed except for when the image forming apparatus 1 is on standby, for example.

Next, the fan arranged toward each of the writing device, the developing unit, the toner supply device, and the sheet feed unit 15 is described. When the image forming apparatus 1 is in the quiet mode, the fan is set to low speed. On the other hand, when the image forming apparatus 1 is in the standard mode, the fan is set to high speed except for when the image forming apparatus 1 is on standby, for example.

The lower the speed, the lower the noise. Thus, the flow rate or the speed of the fan is adjusted according to the operating mode, thereby providing a low-noise environment for people near the image forming apparatus 1.

The exemplary embodiment has been described using example cases in which the image forming apparatus 1 is a standard mode and a quiet mode. The standard mode is used when the image forming apparatus 1 executes a function based on an instruction provided by a user from the operation unit 7. The quiet mode is used when the image forming apparatus 1 executes a function based on an instruction provided by a user from the external terminal 90. However, the exemplary embodiment is not limited thereto.

Particularly, in the standard mode, as illustrated in FIG. 28, the image forming apparatus 1 may change productivity according to a thickness of paper on which an image is to be formed. In FIG. 28, the term "thick paper" represents a sheet having a grammage of, for example, 106 $g/m^2$ or greater. The "thick paper" is a relatively thick and hard sheet having stiffness. The term "medium thick paper" represents a sheet having a grammage of, for example, between 82 $g/m^2$ and 105 $g/m^2$, whereas the term "plain paper" represents a sheet having a grammage of, for example, 80 $g/m^2$ or smaller. The "plain paper" is a relatively thin and soft sheet having substantially no stiffness. Moreover, each of the thick paper, the medium thick paper, and the thin paper is a merely example and not limited to the above grammage. Moreover, in FIG. 28, the "high speed" represents the speed of a motor serving as a drive unit when the image forming apparatus 1 is in the standard mode. The "low speed" indicates that the speed of a motor is slower than that when the image forming apparatus 1 is in the standard mode. The "medium speed" indicates that the speed of a motor is between the "high speed" and the "low speed".

For example, a thickness of paper may be input to the operation unit 7 by the user. In such a case, the control unit 81 controls the drive unit according to the paper thickness information input to the operation unit 7. Alternatively, a thickness of paper may be detected by the conveyance roller pair 23 or a sensor (e.g., a transmission-type, a reflection-type, and a filler) near the conveyance roller pair 23. In such a case, the control unit 81 controls the drive unit according to the detected information.

Generally, unlike the use of the plain paper, high-productivity with high quality is difficult to obtain when the thick paper is used. Consequently, the thick paper is generally used to obtain low-productivity with high quality. Accordingly, when the image forming apparatus 1 is in the standard mode, the use of the plain paper, the medium thick paper, and the thick paper can achieve high productivity, medium productivity, and low productively, respectively. The high productivity is generated by the high speed of the motor (high drive speed of the motor). The medium productivity is generated by the medium speed of the motor, whereas the low productively is generated by the low speed of the motor.

On the other hand, when the image forming apparatus 1 is in the quiet mode, silence or low noise is prioritized. Thus, the image forming apparatus 1 adjusts the speed of the motor to be less than that in the standard mode or constant.

In a case where the image forming apparatus 1 is set to obtain substantially the same productivity regardless of a difference in paper thickness, high image quality may not always be achieved due to an impact generated when a sheet enters into or exits from a conveyance roller, and a difference in fixing temperature applied to sheets. In the standard mode, productivity can be changed depending to paper thickness of a sheet on which an image is formed, thereby achieving high image quality for the corresponding paper thickness.

In a case where the image forming apparatus 1 needs to maintain high productivity in the standard mode, the motor is operated at high speed. Such high speed of the motor causes a large increase in a heating value, and thus temperature inside the image forming apparatus 1 is increased. Consequently, the fan needs to be operated at high power with high speed to generate airflow inside the image forming apparatus, thereby ejecting the heat from the inside to the outside. On the other hand, the low speed of the motor reduces a heating value. Accordingly, even if the fan is operated at low power with low speed, internal temperature of the image forming apparatus 1 is increased by a small amount.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. An image forming apparatus comprising:

a receiver to receive a print instruction from an external terminal; and a controller to switch one of a standard mode and a quiet mode, operating noise being relatively lower in the quite mode than that in the standard mode, and to execute a print operation in the standard mode based on a print instruction from an operator, wherein when the print instruction from the operator is provided while a print operation is being executed in the quiet mode, the controller is configured to switch an operating mode of the image forming apparatus to the standard mode to execute a print operation based on the print instruction from the operator after a print operation being executed when the print instruction from the external terminal, provided via the receiver, is finished or stopped.

2. The image forming apparatus according to of claim 1, wherein when the print instruction from the operator is provided while a print operation is being executed in the quiet mode, the controller is configured to switch the operating mode to the standard mode to execute a print operation based on the print instruction from the operator after a print operation being executed when the print instruction from the external terminal, provided via the receiver, is finished.

3. The image forming apparatus of claim 2, wherein, when the print instruction from the operator is provided while a print operation based on one of a plurality of print instructions is being executed in the quiet mode, the controller configured to switch the operating mode to the standard mode to execute a print operation based on the print instruction from the operator after the print operation being executed when the print instruction from the operator is finished.

4. The image forming apparatus of claim 1, wherein, when the print instruction from the operator is provided while a print operation is being executed in the quiet mode, the controller is configured to switch the operating mode to the standard mode to execute a print operation based on the print instruction from the operator after a print operation being executed when the print instruction from the external terminal, provided via the receiver, is stopped.

5. The image forming apparatus of claim 1, wherein the print instruction from the operator includes a copy instruction.

6. The image forming apparatus of claim 1, further comprising:

a detector to detect a print medium, wherein, when a print operation being executed is stopped or finished, the controller is configured to switch an operating mode of the image forming apparatus after the detector detects the print medium being conveyed.

7. The image forming apparatus of claim 6, wherein the detector is further configured to detect ejection of a print medium.

8. The image forming apparatus of claim 6, wherein the detector is further configured to detect passage of a print medium through a transfer unit.

9. An image forming apparatus comprising:

a receiver to receive a print instruction from an external terminal; and a controller to switch one of a standard mode and a quiet mode, operating noise being relatively lower in the quite mode than in the standard mode, and to execute a print operation in the standard mode based on a print instruction from an operator, wherein, when an instruction for setting an operating mode to the quiet mode is provided from the operator while a print operation based on one of a plurality of print instructions is being executed in the standard mode, the controller is configured to switch an operating mode of the image forming apparatus to the quiet mode after the print operation, executed when the instruction for setting to the quiet mode is provided, is finished, unless the print instruction from the operator is provided.

10. The image forming apparatus of claim 9, wherein the print instruction from the operator includes a copy instruction.

11. The image forming apparatus of claim 9, further comprising:

a detector to detect a print medium, wherein, when a print operation being executed is stopped or finished, the controller is configured to switch an operating mode of the image forming apparatus after the detector detects the print medium being conveyed.

12. An image forming apparatus comprising:

a receiver to receive a print instruction from an external terminal; and a controller to switch one of a standard mode and a quiet mode, operating noise being relatively lower in the quiet mode than in the standard mode, and to execute a print operation in the standard mode based on a print instruction from an operator, the controller being further configured to set an operating of the image forming apparatus to the quiet mode, after a print operation based on the print instruction from the operator is finished.

13. The image forming apparatus of claim 12, wherein the controller is configured to set the operating mode to the quiet mode after a print operation based on the print instruction from the operator is finished, regardless of presence or absence of a print operation to be continued.

14. The image forming apparatus of claim 12, wherein the controller is configured to set the operating mode to the quiet mode when a print operation based on the print instruction from the external terminal is executed, after a print operation based on the print instruction from the operator is finished.

15. The image forming apparatus of claim 12, wherein the print instruction from the operator includes a copy instruction.

16. The image forming apparatus of claim 12, further comprising:

a detector to detect a print medium, wherein, when a print operation being executed is stopped or finished, the controller is configured to switch an operating mode of the image forming apparatus after the detector detects the print medium being conveyed.

17. An image forming apparatus comprising:

a receiver to receive a print instruction from an external terminal;

a controller to switch one of a standard mode and a quiet mode, operating noise being relatively lower in the quiet mode than in the standard mode, and to execute a print operation in the standard mode based on a print instruction from an operator; and a detector to detect a print medium, wherein, when a print operation being executed is stopped or finished, the controller is configured to switch an operating mode of the image forming apparatus after the detector detects the print medium being conveyed.

18. The image forming apparatus of claim 17, wherein the detector is further configured to detect ejection of a print medium.

19. The image forming apparatus of claim 17, wherein the detector is further configured to detect passage of a print medium through a transfer unit.

20. The image forming apparatus of claim 17, wherein the print instruction from the operator includes a copy instruction.

* * * * *